US010056188B2

(12) United States Patent
Mochizuki et al.

(10) Patent No.: US 10,056,188 B2
(45) **Date of Patent: *Aug. 21, 2018**

(54) PRODUCING METHOD OF R-T-B-BASED SINTERED MAGNET

(75) Inventors: Mitsuaki Mochizuki, Saitama (JP); Shoji Nakayama, Saitama (JP); Kazuhiro Sonoda, Saitama (JP)

(73) Assignee: HITACHI METALS, LTD., Tokyo (JP)

( * ) Notice: Subject to any disclaimer, the term of this patent is extended or adjusted under 35 U.S.C. 154(b) by 837 days.

This patent is subject to a terminal disclaimer.

(21) Appl. No.: 13/980,944

(22) PCT Filed: Jan. 26, 2012

(86) PCT No.: PCT/JP2012/051620

§ 371 (c)(1),
(2), (4) Date: Jul. 22, 2013

(87) PCT Pub. No.: WO2012/105399

PCT Pub. Date: Aug. 9, 2012

(65) Prior Publication Data

US 2013/0309122 A1 Nov. 21, 2013

(30) Foreign Application Priority Data

Jan. 31, 2011 (JP) ..... 2011-017846

(51) Int. Cl.
*B22F 3/12* (2006.01)
*B22F 3/16* (2006.01)
(Continued)

(52) U.S. Cl.
CPC ..... *H01F 41/0246* (2013.01); *C22C 1/02* (2013.01); *C22C 38/002* (2013.01);
(Continued)

(58) Field of Classification Search
CPC .... B22F 3/004; B22F 3/12; B22F 3/16; B22F 7/008; B22F 2201/00; B22F 2201/02;
(Continued)

(56) References Cited

U.S. PATENT DOCUMENTS 6,080,245 A * 6/2000 Uchida ..... B22F 9/04 148/103
6,491,765 B2 * 12/2002 Okayama ..... B82Y 25/00 148/101
(Continued)

FOREIGN PATENT DOCUMENTS

CN 1272809 C 8/2006
DE 10119772 A1 10/2001
(Continued)

OTHER PUBLICATIONS

Chinese Office Action dated Sep. 30, 2014 in the corresponding Chinese patent application No. 201280006946.8.
(Continued)

*Primary Examiner* — Scott R Kastler
*Assistant Examiner* — Vanessa T. Luk
(74) *Attorney, Agent, or Firm* — Kratz, Quintos & Hanson, LLP

(57) ABSTRACT

The present invention provides a producing method of R-T-B-based sintered magnets in which, the recovery chamber 40 includes inert gas introducing means 42, evacuating means 43, a carry-in port, a discharge port 40*a*, and a recovery container 60. The recovery step includes a carrying-in step of conveying a processing container 50 into the recovery chamber 40, a discharging step of discharging coarsely pulverized powder in the processing container 50 into the recovery chamber 40, a gas introducing step of introducing inert gas into the recovery chamber 40, and an alloy accommodating step of recovering the coarsely pul-
(Continued)

verized powder into the recovery container 60. Addition of pulverization aid is carried out in the alloy accommodating step. A remaining amount of coarsely pulverized powder in the recovery chamber 40, an oxygen-containing amount of the R-T-B-based sintered magnet is reduced, and magnetic properties are enhanced.

13 Claims, 8 Drawing Sheets

(51) Int. Cl.

| | |
|---|---|
| ***H01F 1/057*** | (2006.01) |
| ***H01F 41/02*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| ***C22C 1/02*** | (2006.01) |
| *B22F 9/04* | (2006.01) |

(52) U.S. Cl.
CPC ..... *C22C 38/005* (2013.01); *C22C 38/06* (2013.01); *C22C 38/10* (2013.01); *C22C 38/16* (2013.01); *H01F 1/0571* (2013.01); *H01F 41/0266* (2013.01); *B22F 2009/044* (2013.01); *B22F 2998/10* (2013.01); *B22F 2999/00* (2013.01); *H01F 1/0577* (2013.01)

(58) Field of Classification Search
CPC ..... B22F 2201/10; B22F 2201/11; B22F 2201/12; B22F 2201/20; B22F 2202/05; B22F 2998/00; B22F 2998/10; B22F 2999/00
See application file for complete search history.

(56) References Cited

U.S. PATENT DOCUMENTS 7,141,126 B2 * 11/2006 Kuniyoshi ..... H01F 1/0557 148/101
8,979,973 B2 * 3/2015 Nakayama ..... B22F 8/00 148/105

FOREIGN PATENT DOCUMENTS

| | | | | |
|---|---|---|---|---|
| EP | 1189244 | A2 | | 3/2002 |
| JP | 2005-118625 | A1 | | 5/2005 |
| JP | 2006-286859 | A1 | | 10/2006 |
| JP | 2006286859 | A | * | 10/2006 |
| JP | 2011-214044 | A1 | | 10/2011 |
| WO | WO 2011/013489 | A1 | | 2/2011 |

OTHER PUBLICATIONS

International Search Report for International Application No. PCT/JP2012/051620 dated May 1, 2012.
Extended European Search Report for counterpart EPC Patent Application No. 12742724.3 dated Jan. 19, 2018 (8 Sheets).

* cited by examiner

[Fig. 1]
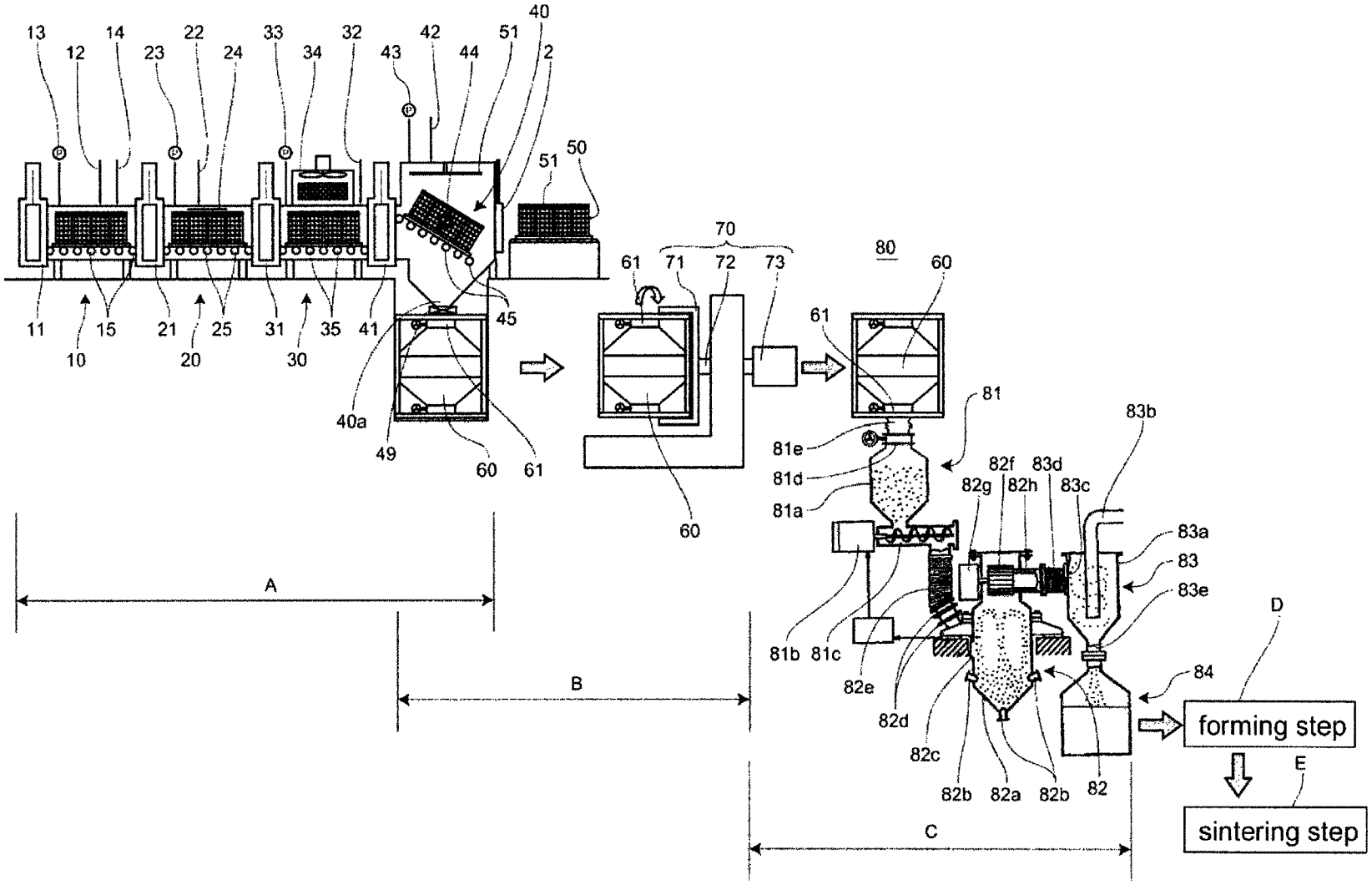

[Fig. 2]
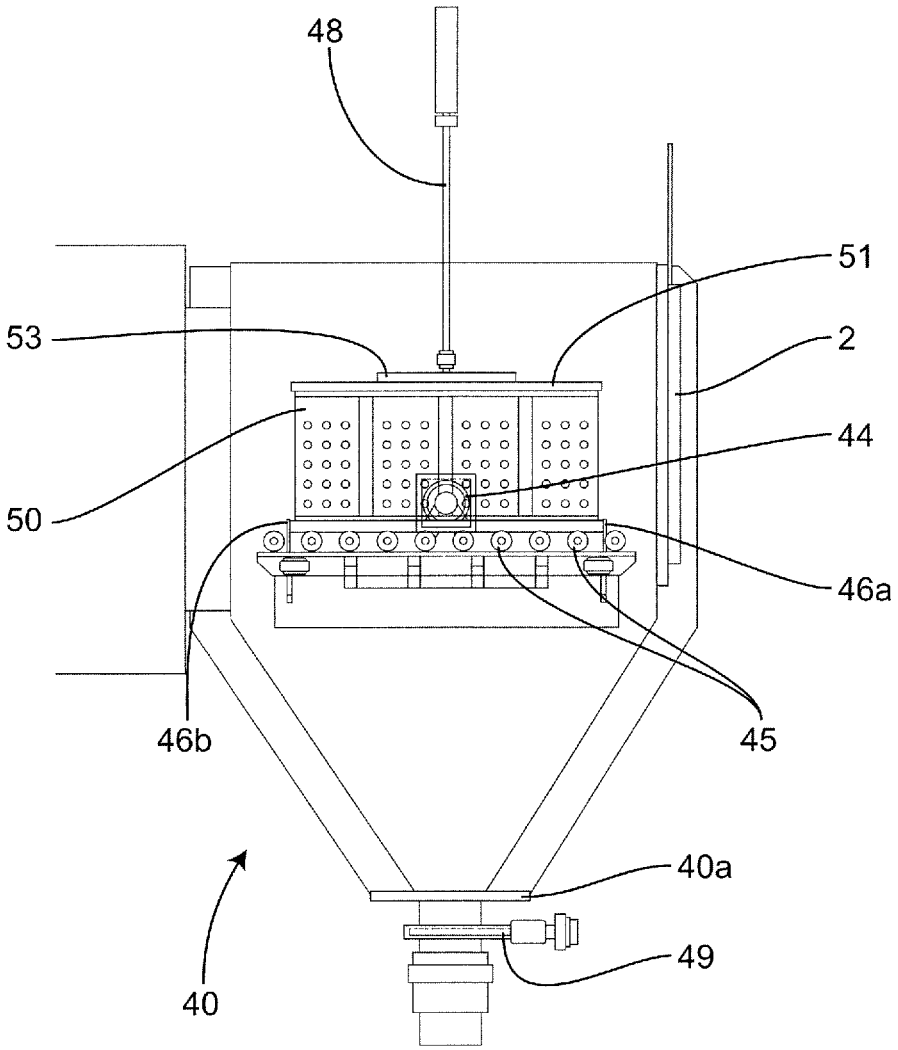

[Fig. 3]
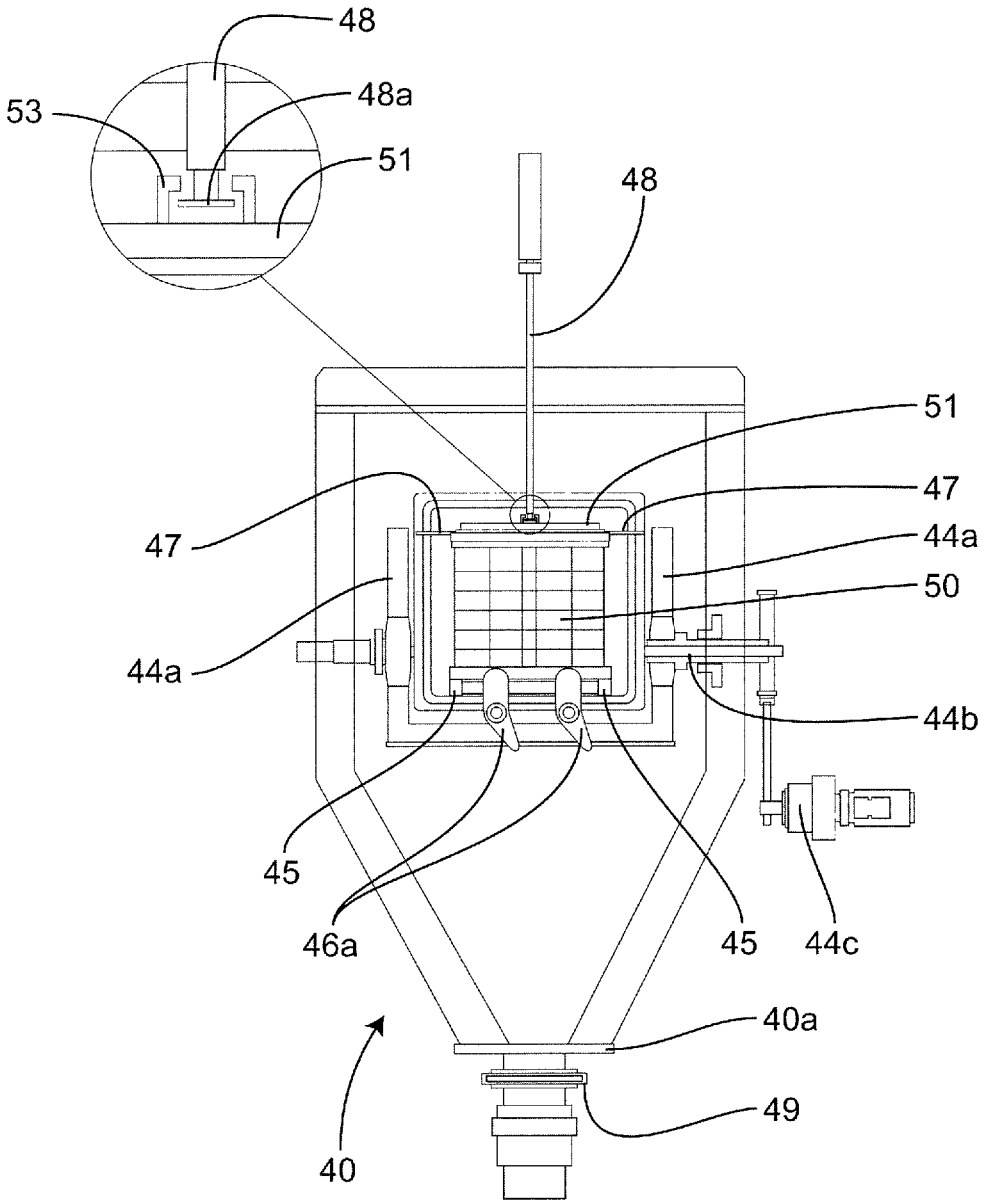

[Fig. 4]
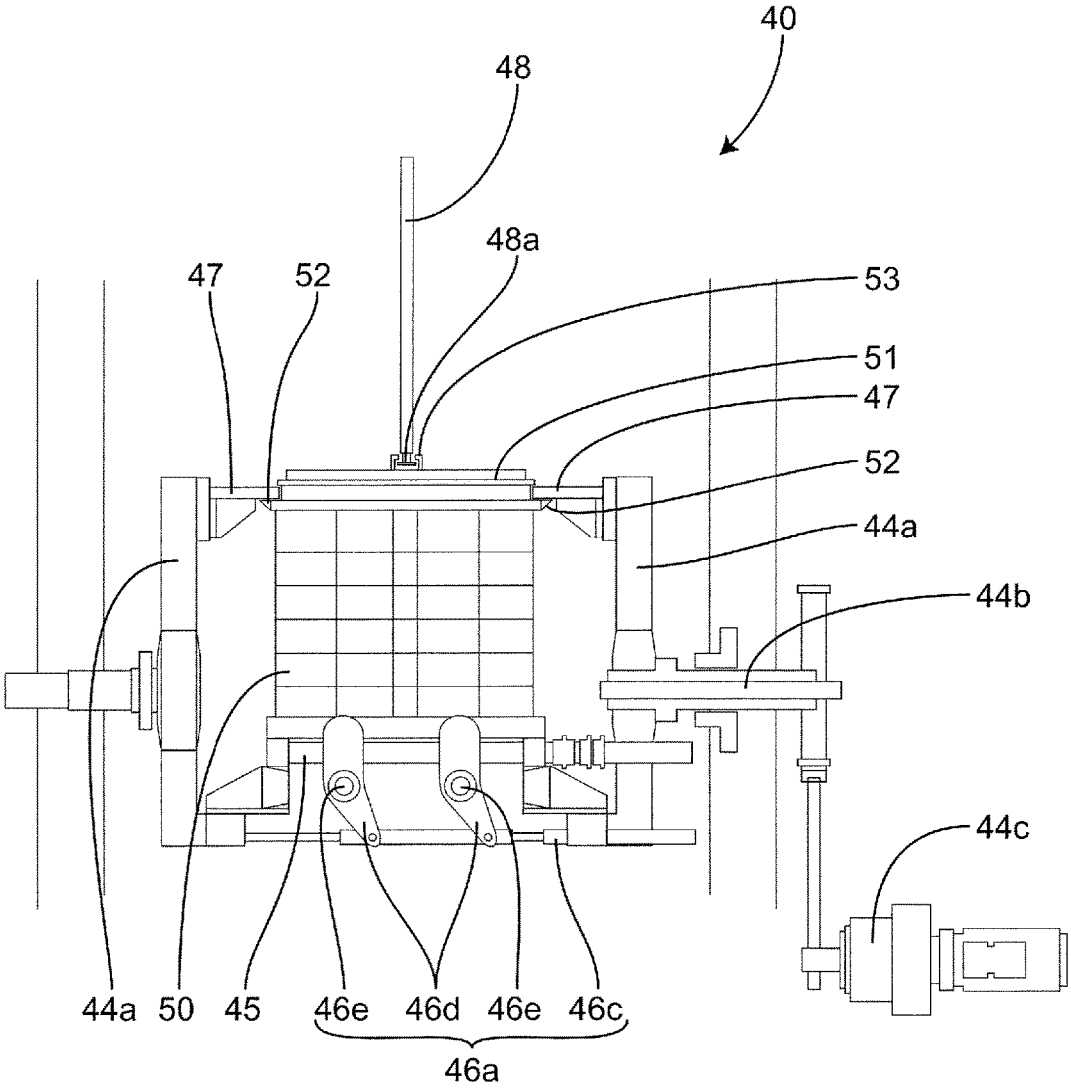

[Fig. 5]
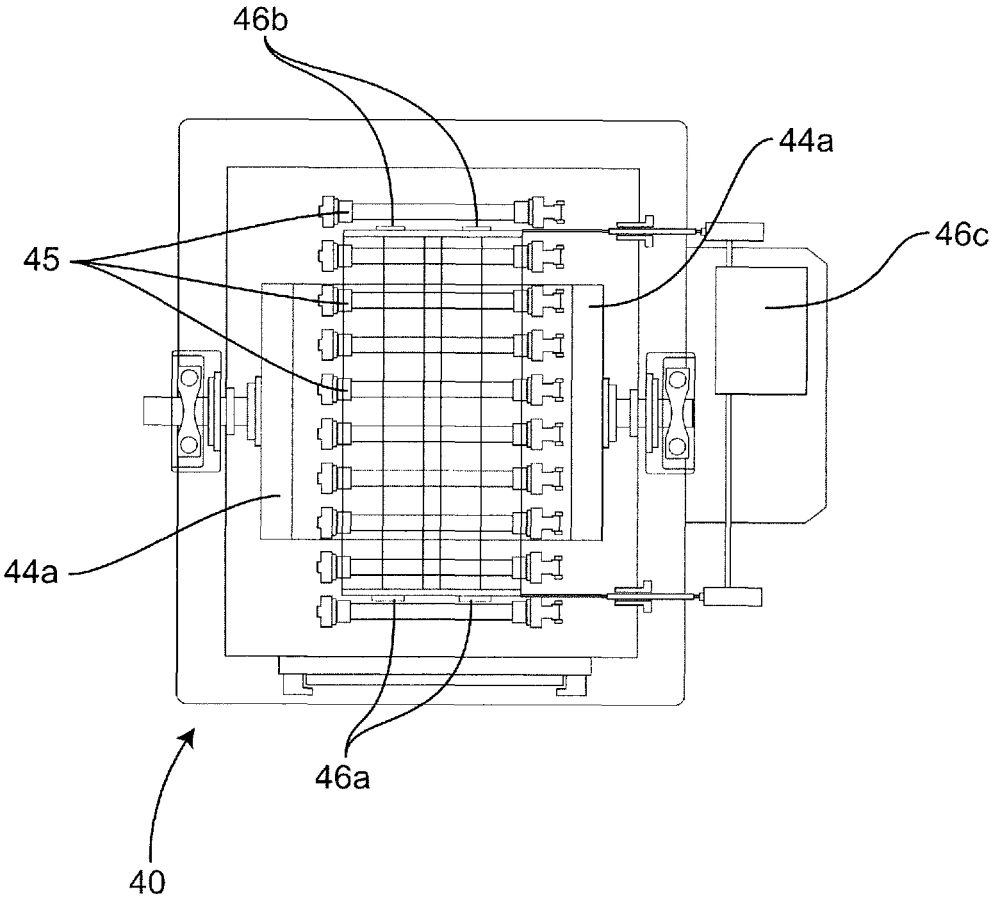

[Fig. 6]
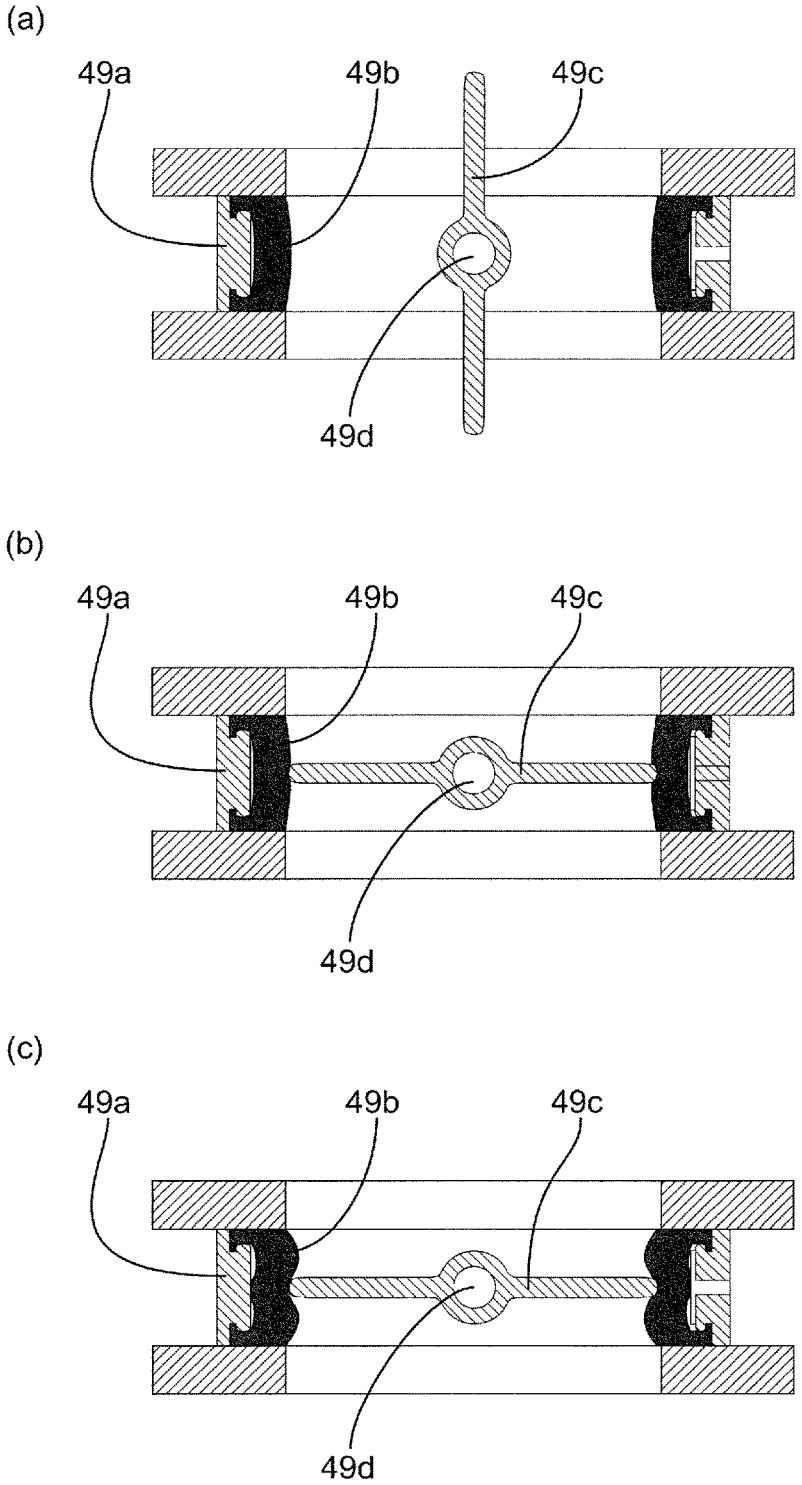

[Fig. 7]
(a)
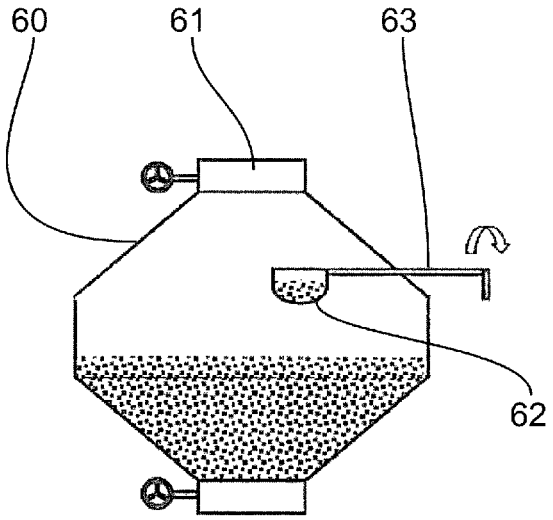
(b)
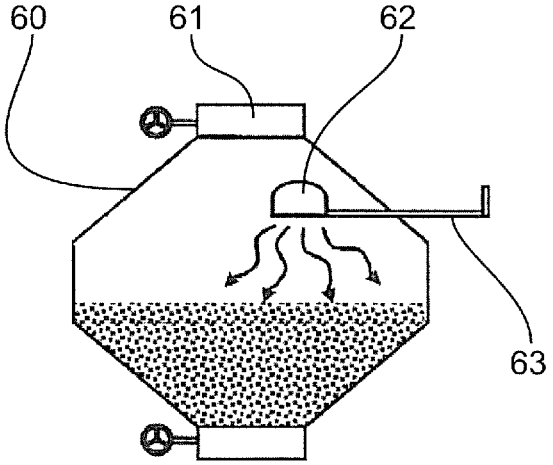

[Fig. 8]
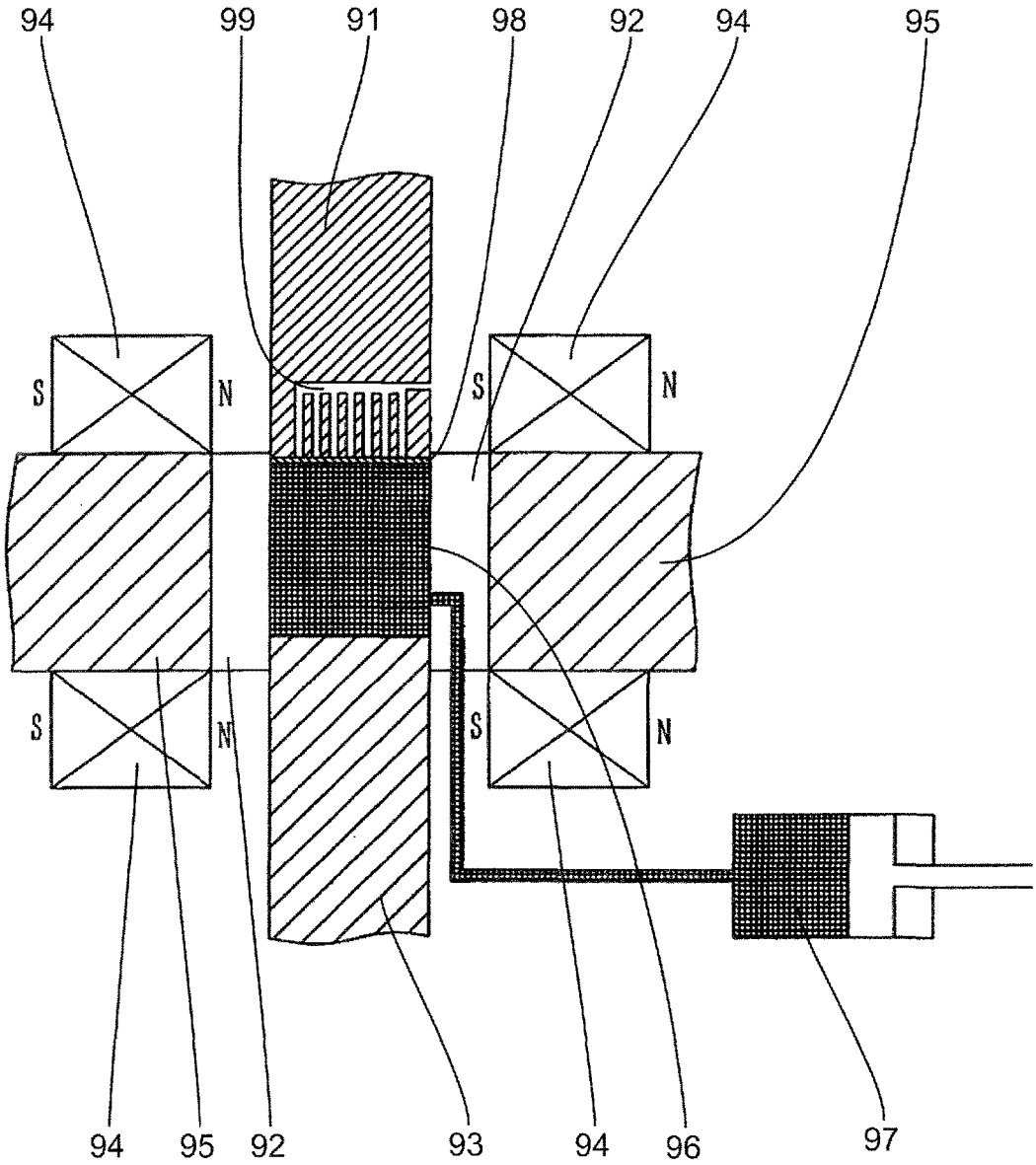

PRODUCING METHOD OF R-T-B-BASED SINTERED MAGNET

TECHNICAL FIELD

The present invention relates to a producing method of an R-T-B-based sintered magnet.

BACKGROUND TECHNIQUE

As high-performance rare-earth sintered magnet, two kinds of magnets, i.e., an R—Co-based sintered magnet (R is mainly Sm) and an R-T-B-based sintered magnet (R is at least one kind of rare-earth element and absolutely includes Nd, and T is Fe or Fe+Co) are widely used.

Especially, since the R-T-B-based sintered magnet shows the highest magnetic energy product among various magnets and a price thereof is relatively low, this magnet is employed for various electric devices.

The R-T-B-based sintered magnet is mainly composed of: main phase comprising tetragonal compound of mainly $R_2T_{14}B$; R-rich phase; and B-rich phase. In the case of the R-T-B-based sintered magnet, basically, if an existence ratio of the tetragonal compound of $R_2T_{14}B$ which is the main phase is increased, magnetic properties are enhanced. However, R easily reacts with oxygen in an atmosphere, and creates oxide such as $R_2O_3$. Therefore, if raw-material alloy for R-T-B-based sintered magnet or its powder is oxidized during a producing operation, the existence ratio of $R_2T_{14}B$ is lowered, the R-rich phase is reduced and the magnetic properties are abruptly lowered. That is, if oxidization is prevented during the producing operation and an oxygen-containing amount of the raw-material alloy for R-T-B-based sintered magnet or its powder is reduced, the magnetic properties are enhanced.

The R-T-B-based sintered magnet is produced in the following manner. That is, a raw-material alloy is coarsely pulverized and finely pulverized to form alloy powder, the alloy powder is formed by pressing, and it is subjected to a sintering step and a thermal processing step. When the R-T-B-based sintered magnet is produced, in the process for coarsely pulverizing the raw-material alloy, since the pulverizing efficiency is high, hydrogen pulverizing operation is frequently used.

The hydrogen pulverizing operation is a technique in which hydrogen is stored in a raw-material alloy to make it brittle, thereby pulverizing the raw-material alloy, and this operation is carried out by doing the following steps.

First, an alloy which is raw material is inserted into a hydrogen furnace and then, an interior of the hydrogen furnace is decompressed by evacuation (vacuuming). Thereafter, hydrogen gas is supplied into the hydrogen furnace and the raw-material alloy is made to store hydrogen (hydrogen storing step). After predetermined time is elapsed, the raw-material alloy is heated (heating step) while evacuating the interior of the hydrogen furnace, and hydrogen is discharged from the raw-material alloy. Thereafter, the raw-material alloy is cooled (cooling step) and the hydrogen pulverizing operation is completed. According to this, the raw-material alloy is made brittle and coarsely pulverized powder is obtained.

The coarsely pulverized powder after the hydrogen pulverizing operation is pulverized into fine pulverized powder of a few μm.

Since the fine pulverized powder has a surface area greater than that of the coarsely pulverized powder, the fine pulverized powder is prone to be oxidized. Hence, oxidization of mainly the fine pulverized powder was conventionally prevented.

For example, there are proposed a technique (patent document 1) in which fine pulverized powder after fine pulverizing operation is put directly into mineral oil and then, the pulverized powder is formed, thereby lowering oxygen in sintered compact, and a technique (patent document 2) in which liquid lubricant is added to fine pulverized powder after fine pulverizing operation, surfaces of the particles are covered, thereby preventing oxidization of the fine pulverized powder. These methods propose to lower oxygen of fine pulverized powder.

As a method of obtaining a raw-material alloy for the R-T-B-based sintered magnet, strip casting is frequently used in recent years. In the strip castings, generally, raw-material alloy for R-T-B-based sintered magnet of 1 mm or less can be produced. Raw material alloy produced by the strip casting method is cooled relatively for a short time as compared with raw-material alloy produced by the conventional ingot casting method (mold casting method). Therefore, texture of the former raw-material alloy is refined, and crystal grain size is small. Thus, it is possible to obtain a sintered magnet having high magnetic properties as compared with the conventional sintered magnet. The raw-material alloy produced by the strip casting method has a large total area of grain boundary and has excellent dispersibility of R-rich phase. Hence, the raw-material alloy is prone to store hydrogen at the time of hydrogen pulverization and is prone to become brittle. Therefore, a particle diameter of the coarsely pulverized powder after hydrogen pulverization is small as compared with raw-material alloy produced by the conventional ingot casting. Further, since R-rich phases are dispersed, R-rich phase is prone to appear on the surface of particle, and the raw-material alloy is prone to be oxidized.

Heretofore, it is known that also in the case of coarsely pulverized powder having a relatively large particle diameter, if the coarsely pulverized powder comes into contact with an atmosphere during the producing operation, oxidization proceeds and an oxygen-containing amount is increased. However, since an increasing amount of oxygen is small as compared with fine pulverized powder, oxidization preventing measures are not taken almost at all. However, as the strip castings becomes popular as described above, it becomes necessary to prevent the oxidization also during coarsely pulverizing operation.

To prevent oxidization of coarsely pulverized powder (hydrogen pulverized powder) after hydrogen pulverizing operation, there is proposed a technique (patent document 3) in which a step in a recovery chamber for discharging hydrogen pulverized powder from a hydrogen pulverizer is carried out in inert gas.

PRIOR ART DOCUMENTS

Patent Documents

[Patent Document 1] Japanese Patent Publication No. 2731337

[Patent Document 2] Japanese Patent Publication No. 3418605

[Patent Document 3] Japanese Patent Application Laid-open No. 2005-118625

SUMMARY OF THE INVENTION

Problem to be Solved by the Invention

As proposed in the patent document 3, hydrogen pulverized powder (coarsely pulverized powder) can prevent oxidization by managing the same in inert gas.

According to the patent document 3, a recovery process is carried out in a recovery chamber through which coarsely pulverized powder is discharged from a hydrogen pulverizer, and this recovery process is carried out for every conveying container in which coarsely pulverized powder is accommodated. That is, a step in which coarsely pulverized powder in the conveying container is made to drop to a bottom in the recovery chamber and coarsely pulverized powder on the bottom in the recovery chamber is discharged to the recovery container is repeated for every conveying container. The conveying container from which coarsely pulverized powder is discharged is conveyed outside of the recovery chamber but when this conveying container is carried outside, the recovery chamber is released to outside air. The recovery chamber which is released to outside air is evacuated before a new conveying container is carried in, inert gas is introduced and thus, oxygen does not exist. Hence, coarsely pulverized powder in the newly carried conveying container is not oxidized.

However, if coarsely pulverized powder remains in the recovery chamber, the remaining coarsely pulverized powder is oxidized in the communicated state with outside air, and the oxidized coarsely pulverized powder is mixed into coarsely pulverized powder in the conveying container.

According to the method disclosed in the patent document 3, since the coarsely pulverized powder is discharged from a conveying container in the inert gas, there is a possibility that coarsely pulverized powder which dropped stirs up and accumulates in the recovery chamber and remains.

Although it is not described in the patent document 3, to recover the accumulated coarsely pulverized powder without remaining, it is conceived that an air hammer is placed at a funnel-shaped portion of a lower portion of a box-shaped cylindrical container and the accumulated coarsely pulverized powder is made to drop from the air hammer. However, a large scale device is required, and it is difficult to discharge all the coarsely pulverized powder which remains in a carry-in port through which a conveying container comes in and out, on a carrying device and on the recovery chamber except on the funnel-shaped portion.

The coarsely pulverized powder which remains in the recovery chamber is gradually oxidized, it is mixed into another coarsely pulverized powder which is processed next time and as a result, an amount of oxygen of an obtained sintered magnet is increased and the magnetic properties are deteriorated.

Hence, it is important to prevent oxidized coarsely pulverized powder from mixing especially by eliminating residues of coarsely pulverized powder in the recovery chamber.

Hence, it is an object of the present invention to provide a producing method of R-T-B-based sintered magnet capable of lowering a possibility that coarsely pulverized powder after hydrogen pulverization remains in a recovery chamber, and capable of enhancing magnetic properties by extremely reducing an oxygen-containing amount of an obtained R-T-B-based sintered magnet.

Means for Solving the Problem

According to a first aspect of the present invention, there is provided a producing method of an R-T-B-based sintered magnet, comprising: a coarsely pulverizing step of obtaining coarsely pulverized powder of raw-material alloy for R-T-B-based sintered magnets; a mixing step of adding pulverization aid to the coarsely pulverized powder and mixing the coarsely pulverized powder and the pulverization aid; a fine pulverizing step of supplying, to a jet mill device, the coarsely pulverized powder in which the pulverization aid is mixed in the mixing step, of finely pulverizing the coarsely pulverized powder in inert gas, of recovering the fine pulverized fine pulverized powder in a solvent composed of one kind of mineral oil, synthetic oil and vegetable oil, and of obtaining slurry fine pulverized powder; a forming step of wet forming the fine pulverized powder in a magnetic field to obtain a compact for R-T-B-based sintered magnets; and a sintering step of removing the solvent in the compact for the R-T-B-based sintered magnets, and sintering the same to obtain an R-T-B-based sintered magnet, wherein the coarsely pulverizing step includes: a hydrogen storing step of storing hydrogen into the raw-material alloy for the R-T-B-based sintered magnet accommodated in a processing container; a heating step of heating the coarsely pulverized powder which is pulverized by storing the hydrogen and dehydrogenating the coarsely pulverized powder; a cooling step of cooling the heated coarsely pulverized powder; and a recovery step of recovering the cooled coarsely pulverized powder into a recovery container, the recovery step is carried out in a recovery chamber which is adjacently connected to a processing chamber where at least the cooling step is carried out, the recovery container includes inert gas introducing means which introduces inert gas, evacuating means which discharges gas in the recovery chamber, a carry-in port through which the processing container is carried into the recovery chamber from the processing chamber, a discharge port disposed in a lower portion of the recovery chamber, and the recovery container connected to the discharge port, the recovery step includes a carrying-in step of carrying the processing container from the processing chamber into the recovery chamber through the carry-in port after inert gas was introduced into the recovery chamber by the inert gas introducing means, a discharging step of discharging the coarsely pulverized powder in the processing container into the recovery chamber after a pressure in the recovery chamber was reduced by the evacuating means, a gas introducing step of introducing inert gas into the recovery chamber by the inert gas introducing means after the coarsely pulverized powder is discharged into the recovery chamber, and an alloy accommodating step of recovering the coarsely pulverized powder into the recovery container through the discharge port after a pressure in the recovery chamber was brought into a predetermined pressure by inert gas, and addition of the pulverization aid in the mixing step is carried out in the alloy accommodating step in the recovery step after the cooling step.

According to a second aspect of the invention, in the producing method of the R-T-B-based sintered magnet of the first aspect, the coarsely pulverized powder and the pulverization aid are mixed in the mixing step by rotating the recovery container.

According to a third aspect of the invention, in the producing method of the R-T-B-based sintered magnet of the second aspect, the coarsely pulverized powder is supplied to the jet mill device by connecting the recovery container rotated in the mixing step to a raw material tank of the jet mill device.

According to a fourth aspect of the invention, in the producing method of the R-T-B-based sintered magnet of the third aspect, inert gas is introduced into a connecting portion between an on/off valve of the recovery container and an on/off valve of the raw material tank and oxygen concentration in the connecting portion is set to 20 ppm or less and then, the on/off valve of the recovery container and the on/off valve of the raw material tank are opened, and the coarsely pulverized powder in the recovery container is supplied to the raw material tank.

According to a fifth aspect of the invention, in the producing method of the R-T-B-based sintered magnet of any one of the first to fourth aspects, the jet mill device finely pulverizes the coarsely pulverized powder in inert gas in which oxygen concentration is 20 ppm or less.

According to a sixth aspect of the invention, in the producing method of the R-T-B-based sintered magnet of any one of the first to fifth aspects, an oxygen-containing amount of the R-T-B-based sintered magnet obtained in the sintering step is set to 600 ppm or less.

According to a seventh aspect of the invention, in the producing method of the R-T-B-based sintered magnet of any one of the first to sixth aspects, one kind of mineral oil, synthetic oil and vegetable oil is sprayed to or dropped onto the compact for the R-T-B-based sintered magnet obtained in the forming step.

According to an eighth aspect of the invention, in the producing method of the R-T-B-based sintered magnet of any one of the first to seventh aspects, the recovery chamber includes turn-over means for turning over the processing container upside down, the processing container is provided at its upper surface with an opening, and the raw-material alloy for the R-T-B-based sintered magnet in the processing container is discharged by an upside down turning over operation carried out by the turn-over means.

According to a ninth aspect of the invention, in the producing method of the R-T-B-based sintered magnet of the eighth aspect, after the upside down turning over operation was carried out by the turn-over means, the turn-over means carries out a swinging operation in a state where the opening is directed downward.

According to a tenth aspect of the invention, in the producing method of the R-T-B-based sintered magnet of the eighth or ninth aspect, the processing container is provided with a lid which covers the opening thereof, the opening is covered with the lid when the evacuating means carries out a decompressing operation, and the lid is detached from the opening after the pressure in the recovery chamber was reduced by the evacuating means and before the upside down turning over operation is carried out by the turn-over means.

According to an eleventh aspect of the invention, in the producing method of the R-T-B-based sintered magnet of the tenth aspect, the hydrogen storing step, the heating step and the cooling step are carried out in a state where the opening of the processing container is covered with the lid.

According to a twelfth aspect of the invention, in the producing method of the R-T-B-based sintered magnet of any one of the first to eleventh aspects, the raw-material alloy for the R-T-B-based sintered magnet is discharged from the processing container under a reduced pressure of 1000 Pa to 1 Pa in the recovery chamber.

According to a thirteenth aspect of the invention, in the producing method of the R-T-B-based sintered magnet of any one of the first to twelfth aspects, inert gas is previously substituted for air in the recovery container such that oxygen concentration becomes 20 ppm or less, and the predetermined pressure in the recovery chamber is set to the same as the pressure in the recovery container.

Effect of the Invention

According to the producing method of the R-T-B-based sintered magnet of the invention, since the pressure in the recovery chamber is reduced when the coarsely pulverized powder of the raw-material alloy for R-T-B-based sintered magnets in the processing container is discharged into the recovery chamber, the coarsely pulverized powder drops without whirling in the recovery chamber and thus, the coarsely pulverized powder does not attach to the inner wall surface of the recovery chamber. Therefore, it is possible to lower a possibility that coarsely pulverized powder which attached to the inner wall surface of the recovery chamber is oxidized when the recovery chamber is opened into outside air when the processing container is carried out and the coarsely pulverized powder is mixed into another coarsely pulverized powder in a next hydrogen pulverizing processing. Hence, it is possible to stably mass produce coarsely pulverized powder of low oxygen also in a continuous operation, and enhance the magnetic properties of the R-T-B-based sintered magnet by extremely reducing an oxygen-containing amount. When it is discharged through the discharge port to the recovery container, since a pressure in the recovery chamber is brought into the predetermined pressure by the inert gas, it is possible to smoothly discharge the same. Therefore, a large-scale apparatus is not required. According to the producing method of the R-T-B-based sintered magnet of the invention, it is possible to largely improve yields of the coarsely pulverized powder.

According to the producing method of the R-T-B-based sintered magnet of the present invention, a pulverization aid in the mixing step is added in an alloy accommodating step by the recovery step after the cooling step. According to this, it is possible to prevent oxidization when the pulverization aid is added, and to enhance the magnetic properties of the R-T-B-based sintered magnet.

BRIEF DESCRIPTION OF THE DRAWINGS

FIG. 1 is a schematic diagram showing a producing step of an R-T-B-based sintered magnet according to an embodiment of the present invention;

FIG. 2 is a front view of an essential portion of a recovery chamber (recovery device of coarsely pulverized powder of a raw material-alloy for R-T-B-based sintered magnet) in the embodiment;

FIG. 3 is a side view of an essential portion of the recovery chamber;

FIG. 4 is an enlarged view of essential portion shown in FIG. 3;

FIG. 5 is a plan view of an essential portion of the recovery chamber;

FIG. 6 are diagrams of a configuration showing operation of a valve provided at an outlet of the recovery chamber;

FIG. 7 are explanatory diagrams showing an adding action of a pulverization aid to coarsely pulverized powder in a mixing step B shown in FIG. 1; and FIG. 8 is a conceptual diagram of a magnetic field forming device used in a forming step D shown in FIG. 1.

EXPLANATION OF SYMBOLS

10 hydrogen storing chamber
20 heating chamber

30 cooling chamber
40 recovery chamber
41 blocking door
42 inert gas introducing means
43 evacuating means
44 turn-over means
45 conveyer means
49 valve
50 processing container
60 recovery container
61 on/off valve
62 bucket
70 mixing device
80 jet mill device
81 raw material throwing device
81*a* raw material tank
81*e* connecting portion
84 recovery tank

MODE FOR CARRYING OUT THE INVENTION

According to the producing method of the R-T-B-based sintered magnet of the first aspect of the invention, the coarsely pulverizing step includes: a hydrogen storing step of storing hydrogen into the raw-material alloy for the R-T-B-based sintered magnet accommodated in a processing container; a heating step of heating the coarsely pulverized powder which is pulverized by storing the hydrogen and dehydrogenating the coarsely pulverized powder; a cooling step of cooling the heated coarsely pulverized powder; and a recovery step of recovering the cooled coarsely pulverized powder into a recovery container, the recovery step is carried out in a recovery chamber which is adjacently connected to a processing chamber where at least the cooling step is carried out, the recovery container includes inert gas introducing means which introduces inert gas, evacuating means which discharges gas in the recovery chamber, a carry-in port through which the processing container is carried into the recovery chamber from the processing chamber, a discharge port disposed in a lower portion of the recovery chamber, and the recovery container connected to the discharge port, the recovery step includes a carrying-in step of carrying the processing container from the processing chamber into the recovery chamber through the carry-in port after inert gas was introduced into the recovery chamber by the inert gas introducing means, a discharging step of discharging the coarsely pulverized powder in the processing container into the recovery chamber after a pressure in the recovery chamber was reduced by the evacuating means, a gas introducing step of introducing inert gas into the recovery chamber by the inert gas introducing means after the coarsely pulverized powder was discharged into the recovery chamber, and an alloy accommodating step of recovering the coarsely pulverized powder into the recovery container through the discharge port after a pressure in the recovery chamber was brought into a predetermined pressure by inert gas, and addition of the pulverization aid in the mixing step is carried out in the alloy accommodating step in the recovery step after the cooling step. According to this aspect, when the coarsely pulverized powder in the processing container is discharged into the recovery chamber, since the pressure in the recovery chamber is reduced, the coarsely pulverized powder drops without whirling in the recovery chamber and the coarsely pulverized powder does not attach to the inner wall surface of the recovery chamber. Therefore, it is possible to lower a possibility that coarsely pulverized powder which attached to the inner wall surface of the recovery chamber is oxidized when the recovery chamber is opened into outside air when the processing container is carried out and the coarsely pulverized powder is mixed into another coarsely pulverized powder in a next hydrogen pulverizing processing. Hence, it is possible to stably mass produce coarsely pulverized powder of low oxygen also in a continuous operation, and enhance the magnetic properties of the R-T-B-based sintered magnet. When it is discharged through the discharge port to the recovery container, since a pressure in the recovery chamber is brought into the predetermined pressure by the inert gas, it is possible to smoothly discharge the same. Therefore, a large-scale apparatus is not required. Further, addition of pulverization aid in the mixing step is carried out in the alloy accommodating step of the recovery step after the cooling step. Therefore, it is possible to prevent oxidization when the pulverization aid is added, and magnetic properties of the R-T-B-based sintered magnet can be enhanced.

According to the second aspect of the invention, in the producing method of the R-T-B-based sintered magnet of the first aspect, the coarsely pulverized powder and the pulverization aid are mixed in the mixing step by rotating the recovery container. According to this aspect, by rotating the recovery container as it is, coarsely pulverized powder is not oxidized in the mixing step.

According to the third aspect of the invention, in the producing method of the R-T-B-based sintered magnet of the second aspect, the coarsely pulverized powder is supplied to the jet mill device by connecting the recovery container rotated in the mixing step to a raw material tank of the jet mill device. According to this aspect, the recovery container is connected to the raw material tank of the jet mill device to supply coarsely pulverized powder. Therefore, the coarsely pulverized powder is less prone to be oxidized as compared with a case where coarsely pulverized powder is transferred from the recovery container into the raw material tank in an atmosphere.

According to the fourth aspect of the invention, in the producing method of the R-T-B-based sintered magnet of the third aspect, inert gas is introduced into a connecting portion between an on/off valve of the recovery container and an on/off valve of the raw material tank and oxygen concentration in the connecting portion is set to 20 ppm or less and then, the on/off valve of the recovery container and the on/off valve of the raw material tank are opened, and the coarsely pulverized powder in the recovery container is supplied to the raw material tank. According to this aspect, oxidization caused by oxygen remaining at the connecting portion can be prevented.

According to the fifth aspect of the invention, in the producing method of the R-T-B-based sintered magnet of any one of the first to fourth aspects, the jet mill device finely pulverizes the coarsely pulverized powder in inert gas in which oxygen concentration is 20 ppm or less. According to this aspect, it is possible to prevent oxidization at the time of fine pulverization carried out by the jet mill device.

According to the sixth aspect of the invention, in the producing method of the R-T-B-based sintered magnet of any one of the first to fifth aspects, an oxygen-containing amount of the R-T-B-based sintered magnet obtained in the sintering step is set to 600 ppm or less. According to this aspect, an oxygen-containing amount of the sintered R-T-B-based sintered magnet is reduced after solvent in the compact for the R-T-B-based sintered magnet is removed. Therefore, it is possible to enhance the magnetic properties.

According to the seventh aspect of the invention, in the producing method of the R-T-B-based sintered magnet of any one of the first to sixth aspects, one kind of mineral oil, synthetic oil and vegetable oil is sprayed to or dropped onto the compact for the R-T-B-based sintered magnet obtained in the forming step. According to this aspect, by reducing oxidization of the compact for the R-T-B-based sintered magnet, it is possible to enhance the magnetic properties.

According to the eighth aspect of the invention, in the producing method of the R-T-B-based sintered magnet of any one of the first to seventh aspects, the recovery chamber includes turn-over means for turning over the processing container upside down, the processing container is provided at its upper surface with an opening, and the raw-material alloy for the R-T-B-based sintered magnet in the processing container is discharged by an upside down turning over operation carried out by the turn-over means. According to this aspect, a possibility that coarsely pulverized powder remains around the opening and the lid is low as compared with a case where the lower portion of the processing container is opened to drop the coarsely pulverized powder, and since the pressure is further reduced, an influence of whirling of coarsely pulverized powder caused by air current of the turning over operation is not generated.

According to the ninth aspect of the invention, in the producing method of the R-T-B-based sintered magnet of the eighth aspect, after the upside down turning over operation was carried out by the turn-over means, the turn-over means carries out a swinging operation in a state where the opening is directed downward. According to this aspect, even a small amount of coarsely pulverized powder remaining in the processing container can completely be made to drop.

According to the tenth aspect of the invention, in the producing method of the R-T-B-based sintered magnet of the eighth or ninth aspect, the processing container is provided with a lid which covers the opening thereof, the opening is covered with the lid when the evacuating means carries out a decompressing operation, and the lid is detached from the opening after the pressure in the recovery chamber was reduced by the evacuating means and before the upside down turning over operation is carried out by the turn-over means. According to this aspect, it is possible to prevent coarsely pulverized powder from being discharged together with gas at the time of the decompressing operation, and whirling of coarsely pulverized powder caused by generation of air current when the lid is opened is not generated.

According to the eleventh aspect of the invention, in the producing method of the R-T-B-based sintered magnet of the tenth aspect, the hydrogen storing step, the heating step and the cooling step are carried out in a state where the opening of the processing container is covered with the lid. According to this aspect, the hydrogen storing step, the heating step and the cooling step can be carried out in the state where the opening of the processing container is covered with the lid, and coarsely pulverized powder is not discharged together with gas when the pressure in the recovery chamber is reduced.

According to the twelfth aspect of the invention, in the producing method of the R-T-B-based sintered magnet of any one of the first to eleventh aspects, the raw-material alloy for the R-T-B-based sintered magnet is discharged from the processing container under a reduced pressure of 1000 Pa to 1 Pa in the recovery chamber. According to this aspect, generation of air current in the recovery chamber can be eliminated, and it is possible to avoid a case where coarsely pulverized powder whirls and the coarsely pulverized powder attaches to the inner wall surface of the recovery chamber.

According to the thirteenth aspect of the invention, in the producing method of the R-T-B-based sintered magnet of any one of the first to twelfth aspects, inert gas is previously substituted for air in the recovery container such that oxygen concentration becomes 20 ppm or less, and the predetermined pressure in the recovery chamber is set to the same as the pressure in the recovery container. According to this aspect, it is possible to prevent coarsely pulverized powder from being oxidized in the recovery container, and easily discharge coarsely pulverized powder into the recovery container from the recovery chamber.

EMBODIMENT

A producing method of an R-T-B-based sintered magnet according to an embodiment of the present invention will be explained below.

FIG. 1 is a schematic diagram showing a producing step of the R-T-B-based sintered magnet according to the embodiment.

As shown in FIG. 1, the producing method of the R-T-B-based sintered magnet according to the embodiment includes a coarsely pulverizing step A, a mixing step B, a fine pulverizing step C, a forming step D and a sintering step E.

In the coarsely pulverizing step A, to obtain coarsely pulverized powder of a raw-material alloy for the R-T-B-based sintered magnet, a hydrogen pulverizer is used.

The hydrogen pulverizer of the embodiment includes a hydrogen storing chamber 10 for making the raw-material alloy for R-T-B-based sintered magnet store hydrogen, a heating chamber 20 for carrying out dehydrogenation by heating coarsely pulverized powder of the raw-material alloy for R-T-B-based sintered magnet which was hydrogen pulverized by storing hydrogen, a cooling chamber 30 for cooling the heated coarsely pulverized powder, and a recovery chamber 40 for recovering the cooled coarsely pulverized powder into the recovery container 60.

The hydrogen storing chamber 10 is provided at its carry-in port with a blocking door 11, and at its carry-out port with a blocking door 21, an alloy is carried out to the heating chamber 20 through the carry-out port, and hermeticity in the hydrogen storing chamber 10 can be maintained. The hydrogen storing chamber 10 includes inert gas introducing means 12 for introducing inert gas, evacuating means 13 for discharging gas in the hydrogen storing chamber 10, hydrogen introducing means 14 for introducing hydrogen gas, and conveyer means 15 for conveying processing container 50.

The heating chamber 20 is provided at its carry-in port with a blocking door 21, and its carry-out port with a blocking door 31, an alloy is carried in from the hydrogen storing chamber 10 through the carry-in port, the alloy is carried out to the cooling chamber 30 through the carry-out port, and the hermeticity in the heating chamber 20 can be maintained. The heating chamber 20 includes inert gas introducing means 22 for introducing inert gas, evacuating means 23 for discharging gas in the heating chamber 20, heating means 24 for heating an interior of the heating chamber 20, and conveyer means 25 for conveying the processing container 50.

The cooling chamber 30 is provided at its carry-in port with a blocking door 31, and at its carry-out port with a blocking door 41, an alloy is carried in from the heating chamber 20 through the carry-in port, the alloy is carried out to the recovery chamber 40 through the carry-out port, and hermeticity in the cooling chamber can be maintained. The cooling chamber 30 includes inert gas introducing means 32 for introducing inert gas, evacuating means 33 for discharging gas in the cooling chamber 30, cooling means 34 for cooling an interior of the cooling chamber 30, and conveying means for conveying the processing container 50.

The recovery chamber 40 is provided at its carry-in port with a blocking door 41, at its carry-out port with a blocking door 2, an alloy is carried in from the cooling chamber 30 through the carry-in port, the alloy is carried outside of a furnace through the carry-out port, and hermeticity in the recovery chamber 40 can be maintained. The recovery chamber 40 includes inert gas introducing means 42 for introducing inert gas, evacuating means 43 for discharging gas in the recovery chamber 40, turn-over means 44 for turning over the processing container 50 upside down, and conveyer means 45 for conveying the processing container 50. The recovery chamber 40 is provided at its lower portion with a valve 49, and the recovery container 60 is connected the lower portion of the recovery chamber 40 through the valve 49. The recovery container 60 is provided with an on/off valve 61 for sealing the recovery container 60.

The processing container 50 is transferred to the hydrogen storing chamber 10, the heating chamber 20, the cooling chamber 30 and the recovery chamber 40 in a state where a raw-material alloy for R-T-B-based sintered magnet is accommodated in the processing container 50.

In the invention, it is possible to use a so-called continuous furnace type hydrogen pulverizer in which the hydrogen storing chamber, the heating chamber and the cooling chamber are independent from each other, but it is also possible to use a so-called batch furnace (independent furnace) type hydrogen pulverizer in which the hydrogen storing step, the heating step and the cooling step are carried out in one chamber. Further, it is possible to use a hydrogen pulverizer of a configuration having a chamber which can be used as any of a hydrogen storing chamber and a heating chamber; a cooling chamber, a hydrogen storing chamber; and a chamber which can be used as any of a heating chamber and a cooling chamber, or it is possible to use a hydrogen pulverizer of such a configuration that to enhance the processing ability, a plurality of heating chambers and cooling chambers are provided, and the hydrogen pulverizer includes a hydrogen storing chamber, a first heating chamber, a second heating chamber, a first cooling chamber and a second cooling chamber. The hydrogen pulverizer may have such a configuration that a preparation chamber and a reserve chamber are disposed in front of a hydrogen storing chamber. That is, all of known hydrogen pulverizers can be employed except the recovery chamber.

It is preferable that a raw-material alloy for R-T-B-based sintered magnet which is to be processed by this device is a an R—Fe(Co)—B-M-based magnet.

Here, R is selected from at least one of Nd, Pr, Dy and Tb. It is preferable that R absolutely includes any one of Nd and Pr. More preferably, a combination of rare-earth element expressed by Nd—Dy, Nd—Tb, Nd—Pr—Dy, or Nd—Pr—Tb is used.

Here, Dy and Tb of R exert effect for enhancing a coercive force $H_{cJ}$. In addition to these elements, the raw-material alloy may include other rare-earth element such as a small amount of Ce and La, and misch metal or didym can also be used. Further, R may not be a pure element, and may include impurities which are unavoidable in manufacturing in an industrially available range. A content thereof may be a known content, and a preferably range of the content is 25% by mass or more and 35% by mass or less. If the content is less than 25% by mass, high magnetic properties, especially a high coercive force can not be obtained, and if the content exceeds 35% by mass, a residual magnetic flux density $B_r$ is lowered.

Further, T absolutely includes Fe, and Co can be substituted for 50% or less of T. Here, Co effective for enhancing temperature properties and corrosion resistance, and Co is normally used in combination with 10% by mass or less of Co and the balance of Fe. A content of T occupies the balance of R and B, or R, B and M.

A content of B may be a known content, and a preferable range is 0.9% by mass to 1.2% by mass. If the content of B is less than 0.9% by mass, a high coercive force can not be obtained, and if the content exceeds 1.2% by mass, it is not preferable because a residual magnetic flux density is lowered. Here, C can be substituted for a portion of B. If C is substituted for a portion of B, this is effective because corrosion resistance of a magnet can be enhanced. It is preferable that a content when B and C are added is set within a range of the above-described concentration of B by converting the number of substitutional atoms of C into the number of atoms of B.

In addition to the above-described elements, to enhance the coercive force $H_{cJ}$, M element can be added. The M element is at least one of Al, Si, Ti, V, Cr, Mn, Ni, Cu, Zn, Ga, Zr, Nb, Mo, In, Sn, Hf, Ta and W. The additive amount is preferably 2% by mass. If the additive amount exceeds 5% by mass, a residual magnetic flux density $B_r$ is lowered.

Unavoidable impurities are also permissible. Examples of such impurities are Mn or Cr which is mixed from Fe; Al, Si or Cu which is mixed from Fe—B (ferroboron).

A raw-material alloy for R-T-B-based sintered magnets which is carried into this device is produced by a melting method. The raw-material alloy is produced by an ingot casting method in which a metal which was previously adjusted such that it finally became a necessary composition is melted and it is placed in a mold, a strip casting method in which a molten metal is brought into contact with a single roll, a twin roll, a rotation disk or a rotation cylindrical mold to quench the molten metal, and a solidified alloy which is thinner than an alloy produced by an ingot method is produced, or a quenching method such as a centrifugal casting method. The raw-material alloy for R-T-B-based sintered magnets of the embodiment can be applied to material produced by any of the ingot method and the quenching method, but it is more preferable that the raw-material alloy is produced by the quenching method.

A thickness of the raw-material alloy for R-T-B-based sintered magnets (quenched alloy) produced by the quenching method is in a range of 0.03 mm or more and 10 mm or less, and a shape thereof is a flake shape. The alloy molten metal solidifies from its surface which comes into contact with a cooling roll (roll-contact surface), and crystal starts growing in a columnar form from the roll contact surface in a thickness direction. Since the quenched alloy is cooled in a short time as compared with an alloy (ingot alloy) produced by a conventional ingot casting method (mold casting method), its structure is miniaturized and a crystal grain size is small. An area of a grain boundary is large and R-rich phase largely spreads into the grain boundary and thus, dispersibility of R-rich phase is also excellent. Hence, it is easily fractured at the grain boundary by the hydrogen pulverizing method. By hydrogen pulverizing the quenched alloy, an average size of the coarsely pulverized powder can be made 1.0 mm or less for example.

According to the hydrogen pulverizer of the embodiment, the number of each of the hydrogen storing chamber 10, the heating chamber 20, the cooling chamber 30 and the recovery chamber 40 is one and they are adjacently connected to one another, but especially multiple heating chambers 20 and cooling chambers 30 may be provided to improve the productivity in some cases.

An opening is formed in an upper surface of the processing container 50, and a lid 51 is provided on the opening. Here, the lid 51 does not hermetically close the opening, and a gap through which hydrogen gas or inert gas can come in and out is formed between the lid 51 and the opening. That is, the opening of the processing container 50 is covered with the lid 51. Stainless steel which has a heat resistance and which can relatively easily be machined is suitable as the processing container 50. A capacity and a thickness of the processing container 50 may appropriately be determined in accordance with an amount to be processed at a time and a size of the hydrogen pulverizer. If the upper portion of the processing container 50 is opened, its shape is not limited, but a general shape thereof is a box shape. To enhance efficiencies of hydrogen storing performance, heating performance and cooling performance, it is preferable that a plurality of box-shaped containers are disposed on one pedestal at constant distances from one another. The embodiment uses a processing container having 4 by 2 matrix of box-shaped containers disposed on one pedestal at predetermined distances from one another. It is preferable that the processing container 50 includes a pipe which penetrates the processing container 50. Since the raw-material alloy is put into the processing container 50 and accumulated, temperature variation in the processing container 50 caused by heating or cooling becomes slow, dehydrogenation and cooling performance after the dehydrogenation were not sufficient, and this becomes a cause of variation in magnetic properties of a finally obtained magnet. Hence, a difference in temperature variation between a raw-material alloy on a surface of the processing container 50 and an interior raw-material alloy becomes small by making heating or cooling inert gas pass through the pipe which penetrates the processing container 50, and quality is stabilized. It is possible to further improve the temperature variation of the raw-material alloy by combining pipes having different diameters or by selecting installation places or disposition intervals.

The processing container 50 is transferred to the hydrogen storing chamber 10, the heating chamber 20 and the cooling chamber 30 in a state where the opening is covered with the lid 51.

An operation of the hydrogen pulverizer of the embodiment will be explained using FIG. 1.

A flake-shaped raw-material alloy for R-T-B-based sintered magnets produced by the quenching method is accommodated in the processing container 50 which is carried into the hydrogen storing chamber 10.

The blocking door 11 of the hydrogen storing chamber 10 is opened and the processing container 50 is carried into the hydrogen storing chamber 10. After the processing container 50 is carried into the hydrogen storing chamber 10, the blocking door 11 is closed, the evacuating means 13 is operated and the hydrogen storing chamber 10 is evacuated.

After the hydrogen storing chamber 10 is evacuated and the operation of the evacuating means 13 is completed, the hydrogen introducing means 14 is operated and hydrogen gas is introduced into the hydrogen storing chamber 10. A pressure in the hydrogen storing chamber 10 is set to 0.1 to 0.18 MPa by introducing hydrogen gas, a raw-material alloy for R-T-B-based sintered magnets in the processing container 50 is made to store hydrogen, and a hydrogen storing step is carried out.

After predetermined time is elapsed (after the hydrogen storing operation was completed), the operation of the hydrogen introducing means 14 is completed, the introducing operation of the hydrogen gas is stopped, the evacuating means 13 is operated to remove hydrogen gas in the hydrogen storing chamber 10, thereby carrying out the evacuating operation. According to this, the hydrogen storing step is completed and the procedure is shifted to a next heating step. At that time, the raw-material alloy for R-T-B-based sintered magnets stores hydrogen, the raw-material alloy is made brittle and pulverized and becomes coarsely pulverized powder.

Since a hydrogenation reaction for storing hydrogen is an exoergic reaction, a temperature of a raw-material alloy rises as hydrogen is stored. Normally, when the exoergic reaction is completed and the temperature of the raw-material alloy is decreased and stabilized, it is determined that the hydrogen storing operation is completed and the procedure is shifted to a next heating step. However, long time is required until the temperature is decreased and stabilized, and if a raw-material alloy whose temperature was decreased is moved to the heating chamber, a temperature of the heating chamber is decreased and time is required until its temperature reaches a predetermined temperature.

Hence, it is preferable to employ a method in which it is design such that the hydrogen storing chamber can be heated, and the hydrogen storing operation is carried out in a state where a high temperature is maintained without decreasing the temperature utilizing a temperature rise of the raw-material alloy caused by an exoergic reaction at the time of the hydrogen storing operation. Since hydrogen is stored mainly by the R-rich phase of the grain boundary by storing hydrogen in the high temperature maintaining state, it is possible to shorten the time of the hydrogen storing step and reduce the amount of introduced hydrogen while sufficiently making the raw-material alloy brittle. If the procedure is shifted to a subsequent heating step while maintaining the high temperature maintaining state, since it is possible to prevent the temperature of the heating chamber from decreasing, it is possible to shorten the time of the heating step in the heating chamber and reduce consumption of power which is required for heating.

Next, when the procedure is shifted to the heating step, the processing container 50 is transferred from the hydrogen storing chamber 10 to the heating chamber 20, but before the processing container 50 is transferred, the heating chamber 20 is previously evacuated by the evacuating means 23.

The blocking door 21 is opened, and the processing container 50 is carried into the heating chamber 20 from the hydrogen storing chamber 10 by driving the conveyer means 15 and the conveyer means 25. After the processing container 50 is carried in, the blocking door 21 is closed, the heating chamber 20 is further evacuated by the evacuating means 23 and is heated by the heating means 24. A temperature in the heating chamber 20 is maintained at 500 to 600° C. by the heating means 24, and a pressure of about 1 Pa is maintained by the evacuating means 23. According to this, the dehydrogenation of the coarsely pulverized powder is carried out. In the heating step of the coarsely pulverized powder, the heating chamber 20 is evacuated, but it is possible to increase the temperature rising speed of the raw-material alloy by introducing the inert gas (e.g., argon gas) simultaneously with the evacuation operation to produce an air-flowing state by a predetermined pressure, and time required for the heating step can be shortened.

After the dehydrogenation of the coarsely pulverized powder is sufficiently carried out, inert gas is introduced into the heating chamber 20 by operating the inert gas introducing means 22, and after the inert gas was brought close to atmosphere in the cooling chamber 30, the operation of the inert gas introducing means 22 is completed. Argon gas is preferable as the inert gas.

The blocking door 31 is opened, and the processing container 50 existing in the heating chamber 20 is carried into the cooling chamber 30 from the heating chamber 20 by driving the conveyer means 25 and the conveying means 35, and a cooling step is carried out. After the processing container 50 is carried into the cooling chamber 30, the blocking door 31 is closed, and the interior of the cooling chamber 30 is cooled by the cooling means 34.

The cooling operation is carried out by a fan or by circulation of cooling water in the cooling chamber.

After the cooling step, a recovery step is carried out.

The blocking door 41 is opened, and the processing container 50 existing in the cooling chamber 30 is carried into the recovery chamber 40 from the cooling chamber 30 by driving the conveying means 35 and the conveyer means 45. When the processing container 50 is carried into the recovery chamber 40, inert gas (argon gas) is introduced into the recovery chamber 40 by operating the inert gas introducing means 42, the gas is brought close to atmosphere in the cooling chamber 30, and the operation of the inert gas introducing means 42 is completed.

A carrying-in step in the recovery step is carried out after the operation of the inert gas introducing means 42 is completed.

If the processing container 50 is carried into the recovery chamber 40, the blocking door 41 is closed and the recovery chamber 40 is evacuated by operating the evacuating means 43. The recovery chamber 40 is evacuated and a pressure therein is set to 1000 Pa to 1 Pa, preferably 5 Pa to 1 Pa and in this state, the lid 51 is removed the turn-over means 44 is operated, the coarsely pulverized powder in the processing container 50 is made to drop to the bottom in the recovery chamber 40 and is discharged. The turn-over means 44 is preferable means for discharging the coarsely pulverized powder in the processing container 50 into the recovery chamber 40, but amain feature of the recovery method of the invention is to decompress the recovery chamber 40 when coarsely pulverized powder in the processing container 50 is discharged into the recovery chamber 40. Therefore, if the pressure in the recovery chamber 40 is reduced, discharging means other than the turn-over means 44 may be used.

A discharging step in the recovery step is carried out after a pressure in the recovery chamber 40 is reduced.

The reason why the pressure in the recovery chamber 40 is set to 1000 Pa to 1 Pa, preferably 5 Pa to 1 Pa is as follows.

After the recovering step is completed, an empty processing container 50 is taken out from the blocking door 2 and then, the blocking door 2 is closed and the recovery chamber 40 is evacuated, and the evacuating operation is continued until a next processing container 50 comes from the cooling chamber, and the interior therein is brought close to the atmosphere in the cooling chamber immediately before the processing container 50 is carried in. Therefore, the pressure is returned to the atmospheric pressure by the inert gas (argon gas), the amount of oxygen in the recovery chamber 40 is sufficiently reduced (e.g., 20 ppm or less), and it is unnecessary to take the amount of oxygen into consideration in terms of oxidization prevention of the coarsely pulverized powder. Therefore, the pressure from 1000 Pa to 1 Pa is determined to establish a condition that coarsely pulverized powder does not whirl in the recovery chamber. When the cycle speed of the hydrogen pulverizer is slow or when the evacuating operation cannot sufficiently be carried out until a next processing container 50 comes from the cooling chamber due to inspection or maintenance in the recovery chamber 40, the amount of oxygen in the recovery chamber 40 is sufficiently reduced, it is preferable that the pressure in the recovery chamber 40 is set to 5 Pa to 1 Pa so that the amount of oxygen becomes 20 ppm or less. That is, the pressure of 5 Pa to 1 Pa is determined to establish a condition that the amount of oxygen in the recovery chamber 40 becomes 20 ppm or less. Naturally, since 5 Pa is a vacuum higher than 1000 Pa, the coarsely pulverized powder does not whirl in the recovery chamber. As described above, normally, there is no problem if the pressure in the recovery chamber 40 is 1000 Pa or less, and 5 Pa or less is more preferable.

In the invention, an evacuation degree of 1 Pa or less is not absolutely necessary to prevent the coarsely pulverized powder from being oxidized and prevent the coarsely pulverized powder from whirling in the recovery chamber 40 and even if the evacuation degree is 1 Pa or less, the invention can be carried out.

After the coarsely pulverized powder is made to drop into the recovery chamber 40, a gas introducing step in the recovery step is carried out.

Inert gas (argon gas) is introduced into the recovery chamber 40 by operating the inert gas introducing means 42 again and after the pressure in the recovery chamber 40 reached a predetermined pressure, the operation of the inert gas introducing means 42 is completed. Inert gas is previously substituted for air in the recovery container 60 such that the oxygen concentration becomes 20 ppm or less. By introducing the inert gas (argon gas) into the recovery chamber 40, the predetermined pressure in the recovery chamber 40 is the same as the pressure in the recovery container 60. In this state, the valve 49 and the on-off valve 61 are opened and coarsely pulverized powder is recovered in the recovery container 60, thereby carrying out an alloy-accommodating step in the recovery step.

If the recovery operation of the coarsely pulverized powder into the recovery container 60 is completed, the valve 49 and the on-off valve 61 are closed, and the recovery container 60 is separated from the recovery chamber 40. Thereafter, the blocking door 2 is opened and the processing container 50 is transferred out from the recovery chamber 40.

The recovery step is carried out in the recovery chamber 40 which is adjacently connected to one or more processing chambers where the hydrogen storing step, the heating step and the cooling step are carried out. The recovery chamber 40 includes the inert gas introducing means 42 which introduces inert gas, the evacuating means 43 which discharges out gas in the recovery chamber 40, the carry-in port through which the processing container 50 is carried into the recovery chamber 40 from the processing chamber, and a discharge port 40*a* disposed in a lower portion of the recovery chamber 40. After inert gas is introduced into the recovery chamber 40 by the inert gas introducing means 42, the processing container 50 is carried into the recovery chamber 40 from the processing chamber through the carry-in port, and after the pressure in the recovery chamber 40 is reduced by the evacuating means 43, coarsely pulverized powder in the processing container 50 is discharged into the recovery chamber 40, and after the coarsely pulverized powder is discharged into the recovery chamber 40, inert gas is introduced into the recovery chamber 40 by the inert gas introducing means 42, a pressure in the recovery chamber 40 is set to a predetermined pressure by the inert gas and then, the coarsely pulverized powder is recovered into the recovery container 60 through the discharge port 40*a*. Therefore, when the coarsely pulverized powder in the processing container 50 is discharged into the recovery chamber 40, since the pressure in the recovery chamber 40 is reduced, the coarsely pulverized powder drops without whirling in the recovery chamber 40, and the coarsely pulverized powder does not attach to the inner wall surface of the recovery chamber 40. As described above, it is possible to lower a possibility that coarsely pulverized powder which attached to the inner wall surface of the recovery chamber 40 is oxidized when the recovery chamber 40 is opened into outside air when the processing container 50 is carried out and coarsely pulverized powder is mixed into another coarsely pulverized powder in a next hydrogen pulverizing processing. Hence, it is possible to stably mass produce coarsely pulverized powder of low oxygen also in a continuous operation, and enhance the magnetic properties of the R-T-B-based sintered magnet. When it is discharged through the discharge port 40*a* to the recovery container 60, since a pressure in the recovery chamber 40 is brought into the predetermined pressure by the inert gas, it is possible to smoothly discharge the same. Therefore, a large-scale apparatus is not required.

In the embodiment, the recovery chamber 40 includes the turn-over means 44 which turns over the processing container 50 upside down, the processing container 50 is provided at its upper surface with the opening, coarsely pulverized powder in the processing container 50 is discharged by the upside down turning over operation of the turn-over means 44. Therefore, the possibility that coarsely pulverized powder remains around the opening and around the lid as compared with a configuration that a lower portion of the processing container 50 is opened and coarsely pulverized powder is made to drop, and since the pressure is further reduced, an influence of whirling of coarsely pulverized powder caused by generation of air current of the turning over operation is not generated.

In the embodiment, the processing container 50 is provided with the lid 51 which covers the opening thereof. When the pressure is reduced by the evacuating means 43, the opening is covered with the lid 51 and after the pressure in the recovery chamber 40 is reduced by the evacuating means 43, the lid 51 is detached from the opening before the upside down turning over operation is carried out by the turn-over means 44. Therefore, it is possible to prevent coarsely pulverized powder from being discharged together with gas at the time of the decompressing operation, and the coarsely pulverized powder does not whirl by generation of air current when the lid 51 is opened.

In the embodiment, the hydrogen storing step, the heating step and the cooling step can be carried out respectively by the hydrogen storing chamber 10, the heating chamber 20 and the cooling chamber 30 in the state where the opening of the processing container 50 is covered with the lid 51, and the coarsely pulverized powder is not discharged together with gas when the pressure in the recovery chamber 40 is reduced.

In the embodiment, a raw-material alloy for R-T-B-based sintered magnets is discharged from the processing container 50 under a reduced pressure in the recovery chamber 40 of 1000 Pa to 1 Pa, the generation of air current in the recovery chamber 40 can be eliminated, and it is possible to avoid a case where coarsely pulverized powder whirls and the coarsely pulverized powder attaches to the inner wall surface of the recovery chamber 40.

In the embodiment, inert gas is previously substituted for air in the recovery container 60 such that the oxygen concentration becomes 20 ppm or less, the predetermined pressure in the recovery chamber 40 is set to the same as the pressure in the recovery container 60, thereby preventing coarsely pulverized powder from being oxidized in the recovery container 60, and it is possible to easily discharge coarsely pulverized powder from the recovery chamber 40 into the recovery container 60.

In the above-described coarsely pulverizing step A, an oxygen-containing amount of the obtained coarsely pulverized powder can be made 600 ppm or less.

In the mixing step B, pulverization aid is added to coarsely pulverized powder, and the coarsely pulverized powder and the pulverization aid are mixed.

The pulverization aid is added to the coarsely pulverized powder in the mixing step B in the alloy accommodating step of the recovery step after the cooling step is carried out.

By adding the pulverization aid to the coarsely pulverized powder, it is possible to prevent fine pulverized powder from adhering (seizing) to the inner wall of the jet mill pulverizing chamber by pulverization in inert gas having lowered oxygen concentration in the fine pulverizing step C carried out by the jet mill. Therefore, it is possible to avoid a case where pulverization performance is deteriorated by adhesion of fine pulverized powder to the inner wall of the jet mill pulverizing chamber, and it is possible to continuously pulverize.

Here, pulverization aid includes at least any of hydrocarbon-based lubricant, fatty acid and derivative of fatty acid. The pulverization aid may be liquid but it is preferable that the pulverization aid is particulate matter.

Example of effective hydrocarbon-based lubricant are liquid paraffin, natural paraffin, microcrystallin wax, polyethylene wax, synthetic paraffin and chlorinated naphthalene, and the lubricant is dissolved in any of mineral oil, synthetic oil and vegetable oil or a mixture of these oils and is used.

As fatty acid and/or derivative of fatty acid, metal soap such as zinc stearate is effective.

It is preferable that an amount of hydrocarbon-based lubricant which is dissolved in oil is in a range of 0.01 to 0.20 wt % with respect to coarsely pulverized powder. If the adding amount is less than 0.01 wt %, adhesion (seizing) suppressing effect is not sufficient, and if the adding amount exceeds 0.20 wt %, a carbon-containing amount of R-T-B-based sintered magnet is prone to became high. The hydrocarbon-based lubricant has such properties that it is dissolved in the mineral oil, the synthetic oil or the vegetable oil, and a significant amount of hydrocarbon-based lubricant is removed in a subsequent oil-removing process. Therefore, even if the amount of hydrocarbon-based lubricant exceeds 0.1 wt % and the hydrocarbon-based lubricant is added in a range of 0.11 to 0.20 wt % with the emphasis on of continuous pulverization performance of the jet mill, since an amount of carbon which eventually remains in R-T-B-based sintered magnet can be made 0.10% or less in terms of 100 parts by weight, and this does not cause a practical problem.

It is preferable that fatty acid and/or derivative of fatty acid is in a range of 0.01 to 0.10 Wt % with respect to coarsely pulverized powder.

Coarsely pulverized powder and pulverization aid are mixed using a mixing device 70 shown in FIG. 1.

After the alloy accommodating step in the recovery step, the on/off valve 61 is closed and the recovery container 60 is carried from the recovery chamber 40 into the mixing device 70.

The mixing device 70 includes a clamp portion 71 which holds the recovery container 60, a rotation shaft 72 connected to the clamp portion 71, and an electric motor 73 which rotates the rotation shaft.

By driving the electric motor 73 to rotate the recovery container 60, coarsely pulverized powder and pulverization aid are mixed.

By rotating the recovery container 60 in this manner, pulverized powder and pulverization aid are mixed. According to this, coarsely pulverized powder is not oxidized, and coarsely pulverized powder can efficiently and uniformly be added and dispersed.

In the fine pulverizing step C, coarsely pulverized powder in which pulverization aid is mixed in the mixing step B is supplied to a jet mill device 80 and the coarsely pulverized powder is finely pulverized in inert gas.

The jet mill device 80 will briefly be described below. The jet mill device 80 includes a raw material throwing device 81 which supplies coarsely pulverized powder, a pulverizer 82 which pulverizes the coarsely pulverized powder thrown from the raw material throwing device 81, a cyclone classifier 83 which classifies pulverized powder obtained by pulverization of the pulverizer 82, and a recovery tank 84 in which fine pulverized powder having a predetermined particle size distribution classified by the cyclone classifier 83.

The raw material throwing device 81 includes a raw material tank 81*a* in which coarsely pulverized powder is accommodated, a motor 81*b* which controls a feeding amount of coarsely pulverized powder from the raw material tank 81*a*, and a spiral supply device (screw feeder) 81*c* connected to the motor 81*b*.

The pulverizer 82 includes a vertically long and substantially cylindrical pulverizer body 82*a*. A lower portion of the pulverizer body 82*a* is provided with a plurality of nozzle ports 82*b* to which nozzles are mounted. Inert gas (i.e., nitrogen) is injected at high speed from the nozzles. A raw material throwing pipe 82*c* is connected to a side portion of the pulverizer body 82*a*, and coarsely pulverized powder is thrown into the pulverizer body 82*a* through the raw material throwing pipe 82*c*.

The raw material throwing pipe 82*c* is provided with a valve 82*d* which once holds coarsely pulverized powder to be supplied and which traps a pressure in the pulverizer 82. The valve 82*d* includes a pair of upper and lower valves. The supply device 81*c* and the raw material throwing pipe 82*c* are connected to each other through a flexible pipe 82*e*.

The pulverizer 82 includes a classification rotor 82*f* provided at an upper portion in the pulverizer body 82*a*, a motor 82*g* provided above outside of the pulverizer body 82*a*, and a connecting pipe 82*h* provided above the pulverizer body 82*a*. The motor 82*g* drives the classification rotor 82*f*, and the connecting pipe 82*h* discharges pulverized powder classified by the classification rotor 82*f* to outside of the pulverizer 82.

The cyclone classifier 83 includes a classifier body 83*a*, and a discharging pipe 83*b* is inserted into the classifier body 83*a* from above. A side portion of the classifier body 83*a* is provided with an introducing port 83*c* through which fine pulverized powder classified by the classification rotor 82*f* is introduced. The introducing port 83*c* is connected to the connecting pipe 82*h* through a flexible pipe 83*d*. A lower portion of the classifier body 83*a* is provided with a taking-out port 83*e*, and the recovery tank 84 is connected to the taking-out port 83*e*.

Pulverization aid is mixed in the coarsely pulverized powder in the mixing step B. The coarsely pulverized powder is charged into the recovery container 60 and in this state, the coarsely pulverized powder is supplied to the jet mill device 80.

The recovery container 60 is taken out from the mixing device 70, and the recovery container 60 is connected to the raw material tank 81*a* of the raw material throwing device 81 in a state where the on/off valve 61 is closed. An upper portion of the raw material tank 81*a* is provided with a connecting portion 81*e* through an on/off valve 81*d*, and the recovery container 60 is connected to an end of the connecting portion 81*e*. It is preferable that an air-tightness valve such as a butterfly valve is used as the on/off valve 81*d*.

An operation of the jet mill device 80 will be described below.

First, an atmosphere in the jet mill device 80 is brought into an inert gas atmosphere in which oxygen concentration is 20 ppm or lower. Inert gas is introduced into the connecting portion 81*e* located between the on/off valve 61 of the recovery container 60 and the on/off valve 81*d* of the raw material tank 81*a*, the oxygen concentration in the connecting portion 81*e* is brought into 20 ppm or lower and then, the on/off valve 61 of the recovery container 60 and the on/off valve 81*d* of the raw material tank 81*a* are opened, and coarsely pulverized powder in the recovery container 60 is supplied to the raw material tank 81*a*.

The coarsely pulverized powder supplied to the raw material tank 81*a* is supplied to the pulverizer 82 by the supply device 81*c*. The coarsely pulverized powder supplied from the supply device 81*c* is once dammed up by the valve 82*d*. Here, a pair of upper and lower valves constituting the valve 82*d* alternately opens and closes. That is, when the upper valve opens, the lower valve closes, and when the upper valve closes, the lower valve opens. Since the pair of upper and lower valves alternately opens and closes in this manner, a pressure in the pulverizer 82 does not leak toward the raw material throwing device 81. When the upper valve opens, coarsely pulverized powder is supplied between the upper and lower valves, and when the lower valve opens, coarsely pulverized powder is guided to the raw material throwing pipe 82*c* and introduced into the pulverizer 82.

The coarsely pulverized powder introduced into the pulverizer 82 is whirled into the pulverizer 82 by high speed injection of inert gas from a nozzle port 82*d*, and turns around together with high speed air current. The coarsely pulverized powder is finely pulverized by collision between the coarsely pulverized powders.

The pulverized powder which is finely pulverized in the pulverizer 82 is carried by ascending air current and introduced into the classification rotor 82*f* and classified there, and the coarsely pulverized powder is again pulverized in the pulverizer 82. On the other hand, fine pulverized powder which is pulverized into a predetermined particle diameter or less is introduced into the classifier body 83*a* from the introducing port 83*c* through the connecting pipe 82*h* and the flexible pipe 83*d*. In the classifier body 83*a*, fine pulverized powder having a predetermined particle diameter or greater is accumulated in the recovery tank 84, super fine pulverized powder having a predetermined particle diameter or less is discharged outside from the discharging pipe 83*b* together with inert gas. By removing the super fine pulverized powder through the discharging pipe 83*b*, a ratio of super fine powder (particle diameter: 1.0 μm or less) occupied in powder collected in the recovery tank 84 is adjusted to 10% or less. By removing the R-rich super fine pulverized powder in this manner, an amount of the rare-earth element R in the sintered magnet consumed for coupling with oxygen is reduced, and the magnetic properties can be enhanced.

In this embodiment, the cyclone classifier 83 having a blow-up is used as the classifier which connected to a rear stage of the jet mill device 80. According to such a cyclone classifier 83, super fine powder having the predetermined particle diameter or less is not collected in the recovery tank 84 and rises reversely, and is discharged out from the device through the pipe 83*b*.

The particle diameter of the super fine pulverized powder which is removed to outside of the device from the pipe 83*b* can be controlled by appropriately determining various parameters of a cyclone as described from page 92 to page 96 of "Powder Technology Poket Book" published by Kogyo Chosakai Publishing Co., Ltd. for example, and by adjusting a pressure of inert gas current.

According to the embodiment, it is possible to obtain alloy powder in which the average particle diameter is about 4.0 μm and the ratio of super fine pulverized powder having particle diameter of less than 1.0 μm is 10% or less of the entire pulverized powder. A preferable average particle diameter of the fine pulverized powder used for producing a sintered magnet is 2 μm or more and 10 μm or less. If strip cast alloy is used as the raw-material alloy for R-T-B-based sintered magnet, since metal texture is fine, it is possible to obtain an extremely sharp particle diameter distribution as compared with conventional ingot alloy powder.

To suppress oxidization in a pulverizing step, it is preferable to bring an oxygen amount in high speed current gas (inert gas) used for fine pulverization to several ppm and to a value close to zero as close as possible.

By controlling concentration of oxygen included in atmosphere at the time of fine pulverization, it is possible to set the oxygen-containing amount (weight) of the alloy power after the fine pulverization to 600 ppm.

Although the fine pulverizing step C is described in the embodiment using the jet mill device 80 having the configuration shown in FIG. 1, the present invention is not limited to this, and a jet mill pulverizer having another configuration or a fine pulverizer of another type may be used. As a classifier for removing super fine powder, it is possible to use a van Tongeren classifier or a centrifugal classifier other than the cyclone classifier.

If fine pulverized powder after pulverized powder is finely pulverized using the jet mill device 80 is recovered into solvent composed of one kind of mineral oil, synthetic oil and vegetable oil, slurry fine pulverized powder can be obtained. As a method of obtaining slurry fine pulverized powder, solvent composed of one kind of mineral oil, synthetic oil and vegetable oil, may be previously accommodated in the recovery tank 84 in the jet mill device 80 or the solvent may appropriately be introduced into the recovery tank 84. Alternatively, after the recovery tank 84 is taken out from the classifier body 83*a*, solvent may be poured from the taking-out port 83*e*.

If the fine pulverized powder is made into the slurry form in this manner, it is effective to prevent a bridge from being generated by interaction between the fine pulverized powders, and it is effective to enhance the quality of the surface of the fine pulverized powder, especially to reduce a friction force between the fine powders. It is preferable that kinematic viscosity at a room temperature of mineral oil or synthetic oil is 10 cSt or less. It is preferable that fractionation point of mineral oil or synthetic oil is 400° C. or lower. When conventional organic solvent is used, mold scratch or seizure is prone to generate at the time of a forming operation. To prevent this, it is preferable to use one of mineral oil, synthetic oil and vegetable oil. Further, variation with time of fine pulverized powder of raw-material alloy for R-T-B-based sintered magnet is reduced if one of mineral oil, synthetic oil and vegetable oil is used.

If fine pulverized powder is made into the slurry fine pulverized powder, the fine pulverizing step C is completed.

In the fine pulverizing step C, the oxygen-containing amount of the obtained slurry fine pulverized powder can be made 600 ppm or less.

In the forming step D, fine pulverized powder is wet formed in a magnetic field, and a compact for R-T-B-based sintered magnets is obtained.

As the forming method, it is possible to use known wet forming method such as a vertical magnetic field forming method and a lateral magnetic field forming method.

In the forming step D, slurry fine pulverized powder obtained in the fine pulverizing step C is pressurized and poured into a mold cavity by a pressurizing device, and is pressurized and formed. When it is pressurized and formed, most of solvent composed of one of mineral oil, synthetic oil and vegetable oil is discharged outside of the mold cavity. Since most of the solvent is removed when the fine pulverized powder is pressurized and formed, a charging density of fine pulverized powder through the forming step D becomes high.

It is also effective that the compact for R-T-B-based sintered magnets after the forming step D is placed on a sintered plate and then, one of mineral oil, synthetic oil and vegetable oil is applied, sprayed or dropped on a surface of a compact for R-T-B-based sintered magnets.

Intrinsically, a very small amount of oil adheres to the surface of the compact for R-T-B-based sintered magnets. Therefore, while oil adheres to the surface, it is possible to suppress oxidization of magnetic powder existing in the vicinity of the surface of the compact. However, even if one of mineral oil, synthetic oil and vegetable oil is used, since it has saturated vapor pressure, if the compact is kept in an atmosphere for given time, oil on the surface of the compact evaporates and the magnetic powder on the surface of the compact is oxidized. Hence, if one of mineral oil, synthetic oil and vegetable oil used for the wet forming operation is applied, sprayed or dropped to or on the surface of the wet compact, oil film is further formed and oxidization can be suppressed.

Therefore, after the raw-material alloy for R-T-B-based sintered magnets is hydrogen pulverized and finely pulverized, it is recovered into one of the mineral oil, synthetic oil and vegetable oil. These operations are handled in a circumstance where the pulverized powder is not in contact with oxygen as in this embodiment. This is especially effective for suppress oxidization of a compact for R-T-B-based sintered magnets having an oxygen-containing amount of 600 ppm or less.

It is preferable to apply, spray or drop mineral oil or synthetic oil or mixture oil after the compact for R-T-B-based sintered magnets is placed on the sintered plate.

Since mineral oil or synthetic oil or mixture oil is applied, sprayed or dropped after the compact for R-T-B-based sintered magnets is placed on the sintered plate, the mineral oil or synthetic oil or mixture oil does not enter a portion of the compact for R-T-B-based sintered magnets which is in contact with the sintered plate, or even if the oil enters, the oil does not enter all of its contacting surface. Thus, slip is not generated between the sintered plate and the compact for R-T-B-based sintered magnets, and it is possible to avoid a case where slip is generated, the compact for R-T-B-based sintered magnets comes into the sintered plate in its compact state before the compact is sintered, and seizure of the sintered compact is generated, compacts bump against each other and they become chipped and according to this, the sintered compact becomes chipped.

As described above, in the fine pulverizing step C, fine pulverized powder is recovered into solvent composed of one of mineral oil, synthetic oil and vegetable oil to form slurry fine pulverized powder, and the slurry fine pulverized powder is pressurized and formed. According to this, the oxygen-containing amount of the compact for R-T-B-based sintered magnets obtained in the forming step D can be set to 600 ppm or less.

In the sintering step E, after the solvent in the compact for R-T-B-based sintered magnets is removed, it is sintered to obtain an R-T-B-based sintered magnet.

Before the sintering operation is carried out, solvent is removed (deoiling processing) from the compact for R-T-B-based sintered magnet which is wet formed in the forming step D.

The deoiling processing is carried out by holding the compact at 50 to 500° C., preferably 50 to 250° C. under a pressure of $10^{-1}$ Torr or less for 30 minutes or more. By this deoiling processing, it is possible to remove solvent remaining on the compact for R-T-B-based sintered magnet. It is unnecessary to maintain the heating temperature of the deoiling processing at a constant level if the heating temperature is in a range of 50 to 500° C., and the deoiling processing may be carried out at two or more temperatures. Even if a temperature rising speed from a room temperature to 500° C. under the pressure condition of $10^{-1}$ Torr or less is set to 10° C./min or less, preferably 5° C./min or less, the same effect can be obtained.

After the deoiling processing, the compact for R-T-B-based sintered magnets is heated from the room temperature to a sintering temperature of 950 to 1150° C. and the sintering processing is carried out.

If the deoiling processing is carried out beforehand, it is possible to avoid a case where solvent remaining on a compact for R-T-B-based sintered magnet reacts with a rare-earth element and a rare-earth carbide is produced. It is possible to generate liquid phase of an amount sufficient for sintering, and to obtain high magnetic properties as a sintered compact having sufficient density.

By setting the oxygen-containing amount of an obtained R-T-B-based sintered magnet to 600 ppm or less in the sintering step E, it is possible to enhance the magnetic properties.

Next, further detailed configuration and operation of the recovery chamber explained in FIG. 1 will be explained.

FIG. 2 is a front view of an essential portion of the recovery chamber (coarsely pulverized powder recovery device of a raw-material alloy for R-T-B-based sintered magnets) in the hydrogen pulverizer. FIG. 3 is a side view of an essential portion of the recovery chamber. FIG. 4 is an enlarged view of essential portion shown in FIG. 3. FIG. 5 is a plan view of an essential portion of the recovery chamber.

In FIG. 2 to 5, the blocking door 41, the inert gas introducing means 42 and the evacuating means 43 are not illustrated.

A lower portion of the recovery chamber 40 has a funnel-shape so that coarsely pulverized powder of accumulated raw-material alloy for R-T-B-based sintered magnets can be discharged from the funnel-shape discharge port 40*a* to the recovery container 60 (not shown in FIGS. 2 to 5). The discharge port 40*a* is provided with the valve 49. The recovery container 60 is also provided with the valve (not shown). An air hammer may be provided on the lower portion of the recovery chamber 40.

The recovery chamber 40 includes the conveyer means 45 which is carried in and out the processing container 50. The conveyer means 45 is made up of a plurality of rollers. The recovery chamber 40 includes the later-described turn-over means 44 and pressure measuring means which measures a pressure in the recovery chamber 40.

In the recovery chamber 40, movement-preventing means 46*a* and 46*b* which prevent movement of the processing container 50 in a conveying direction of the conveyer means 45 are provided on both sides in the conveying direction of the processing container 50. The movement-preventing means 46*a* and 46*b* are disposed between rollers which configure the conveyer means 45, and the movement-preventing means 46*a* and 46*b* project and retract toward the processing container 50 from the conveying surface by the rollers. The movement-preventing means 46*a* is provided on the front side in the conveying direction of the processing container 50, and the movement-preventing means 46*b* is provided on the rear side in the conveying direction of the processing container 50.

FIG. 4 shows the movement-preventing means 46*a*. The movement-preventing means 46*a* includes a sliding shaft 46*c* and cam plates 46*d*. One end of each of the cam plates 46*d* is pivotally supported by the sliding shaft 46*c*, the other end thereof is a preventing portion, and the cam plates 46*d* are displaced around rotation shafts 46*e* as turning fulcrums. Therefore, the cam plates 46*d* turn around the rotation shafts 46*e* by the movement of the sliding shaft 46*c*, the preventing portions project and retract with respect to the conveying surface of the conveyer means 45. The movement-preventing means 46*b* also has the same configuration. Shapes, sizes and the number of the movement-preventing means 46*a* and 46*b* are not especially limited.

Separation-preventing means 47 which prevent the processing container 50 from separating from the conveyer means 45 are provided in the recovery chamber 40 on both sides in a direction intersecting with a carry-in direction of the processing container 50 at right angles. The separation-preventing means 47 are provided on the side of the opening of the processing container 50. An outer periphery of the processing container 50 in the vicinity of its opening is provided with flanges 52.

The separation-preventing means 47 are disposed such that they are located on upper portions of the flanges 52 in a state where the processing container 50 is carried in. Here, each of the separation-preventing means 47 has an L-shaped cross section. Although the flanges 52 provided on the processing container 50 are disposed on the outer periphery of the processing container 50 in the vicinity of its opening in the embodiment, the flanges 52 may be disposed on both sides of the processing container 50 such that longitudinal directions of the pair of flanges 52 are oriented to the conveying direction.

The turn-over means 44 includes a base 44*a* which holds the conveyer means 45 and the movement-preventing means 46*a* and 46*b*, a rotation shaft 44*b* which turns the base 44*a*, and a motor 44*c* which drives the rotation shaft 44*b*.

The base 44*a* is configured by a pair of opposed walls which are perpendicular to the roller shaft of the conveyer means 45, and the rotation shaft 44*b* is pivotally supported by the pair of opposed walls. The separation-preventing means 47 are also provided on opposed surfaces of opposed wall surfaces. The rotation shaft 44*b* which turns the base 44*a* and a main rotation shaft which rotates a plurality of rollers are coaxial with each other. The plurality of rollers configure the conveyer means 45.

A lid opening/closing means 48 having an engagement piece 48*a* is provided at an upper location in the recovery chamber 40. The engagement piece 48*a* engages with an engagement piece 53 provided on an upper surface of the lid 51. By the transfer operation by which the processing container 50 is carried into the recovery chamber 40 from the cooling chamber 30, the engagement piece 48*a* provided at the upper location in the recovery chamber 40 engages with the engagement piece 53 provided on the upper surface of the lid 51, and the lid 51 can be detached from the opening by moving the engagement piece 48*a* upward.

Here, one of the engagement pieces 48*a* and 53 has a T-shaped cross section and the other one has a substantially C-shaped cross section. In the embodiment, the engagement piece 53 has the substantially C-shaped cross section and the engagement piece 48*a* has the T-shaped cross section. The engagement pieces 48*a* and 53 are formed from rail members which extend in one direction. In the embodiment, a pair of members having reversed L-shaped cross sections form a slit, thereby expressing the substantially C-shape.

In the embodiment, the lid opening/closing means 48 is provided at the upper location in the recovery chamber 40. By the transfer operation by which the processing container 50 is carried into the recovery chamber 40 from the cooling chamber 30, the engagement piece 48*a* engages with the engagement piece 53, and the lid 51 is detached from the opening by moving the engagement piece 48*a* upward. The engagement piece 48*a* and the engagement piece 53 are engaged with each other utilizing the transfer operation to carry the processing container 50 into the recovery chamber 40. Therefore, the lid opening/closing means 48 can detach the lid 51 from the opening only by moving the engagement piece 48*a* upward.

In the embodiment, the turn-over means 44 turns over the processing container 50 together with the conveyer means 45 in a state where the processing container 50 is placed on the conveyer means 45. By tuning over the conveyer means 45 together with the processing container 50, it is possible to reliably drop the coarsely pulverized powder to the lower portion of the recovery chamber 40 while avoiding a case where the coarsely pulverized powder discharged from the processing container 50 attaches to the conveyer means 45. Further, since the rotation shaft 44*b* which turns the base 44*a* holding the conveyer means 45 and the main rotation shaft which rotates the plurality of rollers configuring the conveyer means 45 are coaxial with each other, it is possible to easily carry out the turning over operation.

The turning over operation first rotates the processing container 50 180°, and points the opening of the processing container 50 directly below. It is preferable that swinging motion is applied one time or a plurality of times thereafter. For example, the processing container 50 is rotated 180°, the opening of the processing container 50 is pointed directly below and then, the processing container 50 is further rotated 45° and from this position, the processing container 50 is turned over 90°. By applying the swinging motion, even a small amount of coarsely pulverized powder accumulated on the pipe which penetrates the processing container 50 can completely be made to drop.

This turning over operation is controlled such that after the evacuating means 43 of the recovery chamber 40 was operated, the turning over operation starts based on information of a pressure measured by the pressure measuring means which measures a pressure in the recovery chamber 40. For example, the turning over operation is started at a pressure of 1000 Pa or less. Various pressure gages and vacuum gages can be used as the pressure measuring means. According to this, when the turning over operation is carried out, coarsely pulverized powder drops without whirling in the recovery chamber 40. Therefore, it is possible to prevent the coarsely pulverized powder from attaching to the inner wall surface of the recovery chamber 40. Oxygen concentration measuring means which measure the oxygen concentration may be provided in the recovery chamber 40 together with the pressure measuring means, the turning over operation may be controlled based on both information sets of the pressure measured by the pressure measuring means and the oxygen concentration measure by the oxygen concentration measuring means, or the turning over operation may be controlled using only the oxygen concentration measuring means.

In the embodiment, inert gas is previously substituted for air in the recovery container 60 such that oxygen concentration becomes 20 ppm or less, and the predetermined pressure in the recovery chamber 40 is set to the same as the pressure in the recovery container 60. According to this, it is possible to prevent the coarsely pulverized powder from being oxidized in the recovery container 60, and easily discharge the coarsely pulverized powder from the recovery chamber 40 into the recovery container 60.

In the embodiment, the movement-preventing means 46*a* and 46*b* are respectively provided on front and rear sides in the conveying direction of the processing container 50, the separation-preventing means 47 which prevent the processing container 50 from separating from the conveyer means 45 are provided on the opening side of the processing container 50, and when the turning over operation is carried out by the turn-over means 44, the pair of movement-preventing means 46*a* and 46*b* and the separation-preventing means 47 can hold the processing container 50 at a predetermined position with respect to the conveyer means 45, and the turning over operation can reliably be carried out also in a narrow space.

In the embodiment, the movement-preventing means 46*a* and 46*b* are provided such that they can project and retract toward processing container 50 from between the rollers which configure the conveyer means 45. According to this, since the gap between the rollers is utilized, the device can be made compact, it is easy to precisely maintain the positional relation with respect to the rollers and thus, the processing container 50 can reliably be held.

In the embodiment, the separation-preventing means 47 are disposed such that they are located on the upper portions of the flanges 52 in a state where the processing container 50 is carried in. By forming the flanges 52 as described above, the flanges 52 and the separation-preventing means 47 can correspond to each other by the conveying operation, and the processing container 50 can be held at a predetermined position.

Next, the configuration and operation of the valve explained in FIG. 1 will be explained.

FIG. 6 are diagrams of a configuration showing operation of a valve provided at an outlet of the recovery chamber.

FIG. 6(*a*) shows an opened state of the valve, FIG. 6(*b*) shows an intermediate state where the valve is going to close and FIG. 6(*c*) shows a closed state of the valve.

A valve 49 includes an annular expanded member 49*b* disposed on an inner peripheral surface of the cylindrical member 49*a*, and a disk member 49*c* having a turning shaft 49*d* directing to a radial direction of the cylindrical member 49*a*.

The annular expanded member 49*b* may be elastically deformable by its own material or a structure thereof, but it is preferable that the annular expanded member 49*b* can be expanded by a gas pressure from outside.

The disk member 49*c* rotates by the turning shaft 49*d* and is brought into the opened state in the state of FIG. 6(*a*). After the cylindrical member 49*a* is moved to a position where the cylindrical member 49*a* is closed by the state shown in FIG. 6(*b*), the annular expanded member 49*b* is expanded and deformed, thereby hermetically closing between the disk member 49*c* and the annular expanded member 49*b*.

According to the valve 49 of the embodiment, influence caused when coarsely pulverized powder attaches is eliminated and hermeticity can be maintained.

The valve 49 is controlled such that it can open and close when the oxygen concentration in the recovery container 60 is 20 ppm or less and a pressure in the recovery chamber 40 becomes equal to the pressure in the recovery container 60 by the inert gas introducing means 42 of the recovery chamber 40. Therefore, it is possible to prevent the coarsely pulverized powder from being oxidized in the recovery container 60, and easily discharge the coarsely pulverized powder from the recovery chamber 40 into the recovery container 60.

Next, an adding operation of pulverization aid to coarsely pulverized powder in the mixing step B shown in FIG. 1 will be described.

FIG. 7 are explanatory diagrams showing the adding operation of pulverization aid to the coarsely pulverized powder.

The recovery container 60 shown in FIG. 7 is connected to the valve 49 of the recovery chamber 40 in FIG. 1.

A bucket 62 having pulverization aid therein is disposed at an upper portion in the recovery container 60, and the bucket 62 is provided with an operation rod 63 which projects outward of the recovery container 60. In a state where the bucket 62 having the pulverization aid therein is disposed in the recovery container 60, inert gas is previously substituted for air in the recovery container 60 such that oxygen concentration becomes 20 ppm or lower.

FIG. 7(*a*) shows a state where coarsely pulverized powder is already recovered in the recovery container 60, but when coarsely pulverized powder is recovered, the bucket 62 having the pulverization aid therein is disposed. Therefore, also when coarsely pulverized powder drops into the recovery container 60, a portion of the coarsely pulverized powder enters the bucket 62, and a portion of pulverization aid in the bucket 62 drops out of the bucket 62. Therefore, in the state shown in FIG. 7(*a*) also, a portion of pulverization aid is already added into coarsely pulverized powder.

FIG. 7(*b*) shows a state where the bucket 62 is turned over by rotation of the operation rod 63, and pulverization aid in the bucket 62 is added to coarsely pulverized powder existing in the recovery container 60.

As described above, in a state where the bucket 62 having pulverization aid therein is disposed in the recovery container 60, inert gas is previously substituted for air in the recovery container 60 such that oxygen concentration becomes 20 ppm or lower. Therefore, when pulverization aid is added, coarsely pulverized powder is not oxidized.

Since the bucket 62 having pulverization aid therein is disposed at the upper portion in the recovery container 60, when coarsely pulverized powder drops into the recovery container 60, a portion of the pulverization aid in the bucket 62 drops out of the bucket 62, and pulverization aid remaining in the bucket 62 is added thereafter. Therefore, pulverization aid can be added to the coarsely pulverized powder such that the pulverization aid is dispersed as compared with a case where pulverization aid is previously poured onto the bottom of the recovery container 60 or a case where the on/off valve 61 is opened after coarsely pulverized powder is recovered into the recovery container 60 and the pulverization aid is added. Hence, uniform mixing in the subsequent mixing step B can be carried out.

It is also possible to add pulverization aid in a state where the recovery container 60 is separated from the recovery chamber 40.

Next, the wet forming operation in the forming step D shown in FIG. 1 will be described.

FIG. 8 is a conceptual diagram of the magnetic field forming device.

The magnetic field forming device shown in FIG. 8 is a so-called lateral magnetic field forming device in which a direction of an oriented magnetic field intersect (lateral direction in FIG. 8) with a pressurizing direction (vertical direction in FIG. 8) at right angles. The magnetic field forming device includes an upper punch 91, a die 92, a lower punch 93 and an oriented magnetic field coil 94. A pair of yokes 95 is disposed to sandwich the die 92, and a pair of oriented magnetic field coils 94 is disposed on the yokes 95. The cavity 96 formed by the die 92, the upper punch 91 and the lower punch 93 is provided with a pressurizing device 97 which pressurizes and press-fits slurry fine pulverized powder. A filter 98 is disposed between the cavity 96 and the upper punch 91, and a solvent discharge path 99 is formed in the filter 98 on a side of the upper punch 91.

The slurry fine pulverized powder is pressurized and press-fitted into the cavity 96 by the pressurizing device 97 and thereafter, the slurry fine pulverized powder is pressurized and formed by the upper punch 91 and the lower punch 93. When the pressurizing and press-forming operation carried out by the upper punch 91 and the lower punch 93, most of solvent composed of one of mineral oil, synthetic oil and vegetable oil included in the fine pulverized powder passes through the solvent discharge path 99 through the filter 98, and is discharged outside of the mold cavity 96.

Although the so-called lateral magnetic field forming device in which the pressurizing direction and the direction of the oriented magnetic field intersect with each other at right angles is used above, it is also possible to use a so-called vertical magnetic field forming device in which the pressurizing direction and the direction of the oriented magnetic field are the same.

Example 1

Raw materials having purity of 99.5% or higher were mixed and dissolved such that composition of an R-T-B-based sintered magnet after it was sintered became A to C in Table 1, it was casted by strip casting, and slab-like raw-material alloy having thickness of 0.3 mm was obtained. In Table 1, "TRE" means "Total Rare Earth" and is a total of an Nd-containing amount, a Pr-containing amount and a Dy-containing amount.

Using the raw-material alloys A to C, a sintered magnet was produced by the following method.

The raw-material alloys of 400 kg were subjected to the hydrogen storing step, the heating step and the cooling step using the hydrogen pulverizer shown in FIG. 1, an interior of the recovery chamber 40 was brought into a vacuum atmosphere of 5 Pa and thereafter, the processing container 50 was turned over, and coarsely pulverized powder of the raw-material alloy was discharged into the recovery chamber 40.

Next, Ar was introduced into the recovery chamber 40 and a pressure therein was brought into an atmospheric pressure. At that time, oxygen concentration in the recovery chamber 40 was 20 ppm or lower.

Ar gas was substituted for gas in the recovery container 60, and the oxygen concentration was set to 20 ppm or lower. Then, the valve 49 of the recovery chamber 40 and the on/off valve 61 of the recovery container 60 were opened, and coarsely pulverized powder of raw-material alloy was recovered in the recovery container 60.

The valve 49 of the recovery chamber 40 and the on/off valve 61 of the recovery container 60 were closed and then, coarsely pulverized powder of raw-material alloy remaining in the recovery chamber 40 was collected, and the coarsely pulverized powder was 0.1 g or less. That is, the recovering rate of coarsely pulverized powder was substantially 100%.

Then, 0.04 wt % of paraffin wax which was previously inserted into the bucket 62 in the recovery container 60 was added to the coarsely pulverized powder by turning over the bucket 62. Next, the recovery container 60 was separated from the recovery chamber 40, the recovery container 60 was fixed to the mixing device 70, it was rotated for 10 minutes, and coarsely pulverized powder and paraffin wax were mixed.

The recovery container 60 was detached from the mixing device 70, and it was connected to the connecting portion 81*e* of the raw material tank 81*a* of the jet mill device 80 by a ferrule. Next, Ar gas was introduced into the connecting portion 81*e*, oxygen concentration in the connecting portion 81*e* was set to 20 ppm or less and then, the on/off valve 61 of the recovery container 60 and the on/off valve 81*d* of the raw material tank 81*a* are opened, coarsely pulverized powder in the recovery container 60 was supplied to the raw material tank 81*a* of the jet mill device 80, and fine pulverization was carried out in Ar gas of 20 ppm or less. Fine pulverized powder after it was fine pulverized was recovered directly into mineral oil. Particle diameters of the obtained fine pulverized powders were measured by a device (Sympatec HEROS (H9242)) complying with 15013320-1, the fine pulverized powders were converted into volumes in an increasing order of the particle diameters, and a particle diameter (D50) corresponding to 50% of the entire volume was obtained and the particle diameter D50 was 4.76 μm.

Slurry composed of the obtained fine pulverized powder and mineral oil was formed by wet forming using the lateral magnetic field forming device shown in FIG. 8, and a compact was obtained. The obtained compact was processed at 200° C. for four hours, and mineral oil in the compact was removed. Thereafter, the compact was sintered at 1040 to 1060° C. for two hours. The obtained sintered compact was processed at 900° C. for one hours in Ar atmosphere and it was subjected to heating processing at 500° C. for two hours.

Compositions of the obtained sintered magnets of A to C are shown in Table 1. An oxygen-containing amount of raw-material alloy, an oxygen-containing amount of the sintered magnet and magnetic properties of the sintered magnet are shown in Table 2.

Comparative Example 1

Raw materials having purity of 99.5% or more were mixed and dissolved such that compositions after they were sintered became D to F in Table 1, the raw materials were casted by strip casting and slab-like raw-material alloy having thickness of 0.3 mm was obtained. Using the raw-material alloys of D to F, three kinds of sintered magnets were produced by the same method as that of the example 1 except that the processing container 40 was turned over in the atmosphere at the time of hydrogen pulverization.

Compositions of the obtained sintered magnets of D to F are shown in Table 1. An oxygen-containing amount of raw-material alloy, an oxygen-containing amount of the sintered magnet and magnetic properties of the sintered magnet are shown in Table 2.

TABLE 1

| | Compositions of sintered magnet (mass %) | | | | | | | | | |
|---|---|---|---|---|---|---|---|---|---|---|
| Sample No. | Nd | Pr | Dy | TRE | B | Al | Ga | Co | Cu | Fe |
| A | 22.45 | 6.25 | 0.50 | 29.20 | 0.95 | 0.07 | 0.08 | 2.00 | 0.10 | 67.60 |
| B | 20.24 | 5.60 | 3.23 | 29.07 | 0.94 | 0.09 | 0.08 | 2.01 | 0.10 | 67.71 |
| C | 19.13 | 5.36 | 4.49 | 28.98 | 0.92 | 0.10 | 0.08 | 2.00 | 0.10 | 67.82 |
| D | 23.04 | 6.36 | 0.44 | 29.84 | 0.93 | 0.09 | 0.09 | 2.01 | 0.10 | 66.94 |
| E | 21.07 | 5.85 | 3.09 | 30.01 | 0.92 | 0.11 | 0.08 | 2.02 | 0.09 | 66.77 |
| F | 20.50 | 5.60 | 4.26 | 30.36 | 0.93 | 0.15 | 0.09 | 2.00 | 0.09 | 66.38 |

TABLE 2

| | Oxygen-containing amount | | Magnetic properties | | |
|---|---|---|---|---|---|
| Sample No. | Raw material alloy (ppm) | Sintered magnet (ppm) | $B_r$ (T) | $H_{cJ}$ (MA/m) | $(BH)_{max}$ (kJ/m$^3$) |
| A | 210 | 520 | 1.477 | 1.150 | 420.1 |
| B | 230 | 530 | 1.408 | 1.654 | 381.7 |
| C | 190 | 560 | 1.371 | 1.852 | 360.0 |
| D | 230 | 1200 | 1.463 | 1.160 | 408.0 |
| E | 180 | 1110 | 1.396 | 1.554 | 375.8 |
| F | 220 | 1180 | 1.347 | 1.853 | 348.1 |

According to the present invention, in each of the producing steps from the raw-material alloy to the sintered magnet, oxidization of the raw-material alloy and its powder is prevented. Especially, it is possible to prevent oxidization of coarsely pulverized powder from the hydrogen pulverization (coarse pulverization) to jet mill pulverization (fine pulverization). Therefore, it is possible to obtain an R-T-B-based sintered magnet having excellent magnetic properties having an oxygen-containing amount of 600 ppm or less as shown in Table 2.

An oxygen-containing amount of a sintered magnet can further be reduced by reducing an oxygen amount of a raw-material alloy or by preventing oxygen from being absorbed into a processing container used in each of the producing steps. It is possible to produce an R-T-B-based sintered magnet having an oxygen-containing amount of 500 ppm or less or 400 ppm or less.

As described in the "Background Technique", an R-T-B-based sintered magnet is composed of a main phase mainly including $R_2T_{14}B$ tetragonal compound and an R-rich phase and a B-rich phase. If an existence ratio of the main phase is increased, magnetic properties especially residual flux density $B_r$ is enhanced. However, R is prone to react with oxygen in an atmosphere and creates oxide such as $R_2O_3$. Therefore, if raw-material alloy for R-T-B-based sintered magnets or its powder is oxidized during the producing step, $R_2O_3$ is produced, the existence ratio of $R_2T_{14}B$ is reduced, the R-rich phase is reduced and the magnetic properties are abruptly deteriorated.

According to the present invention, since oxidized during the producing step is prevented, a produced amount of oxide such as $R_2O_3$ is reduced. Therefore, when R of the same amount as a conventional sintered magnet having a high oxygen-containing amount is included, an excessive amount of exists corresponding to R which is consumed by the oxide.

This excessive R is previously subtracted from the amount of R, the existence ratio of the main phase can be increased, and the residual flux density $B_r$ can be enhanced.

In compositions shown in Table 1, a sample No.A (simply "A", hereinafter, and samples Nos.B to F will also be simply called B to F) are compositions in which an Nd-containing amount in D is reduced. Relations between B and E and between C and F are also the same. Here, assuming that all of oxide produced when Nd and oxygen react with each other is $Nd_2O_3$, if the oxygen-containing amount is increased by 100 ppm, 0.06 mass % Nd is consumed as oxide. That is, if the oxygen-containing amount is reduced by 100 ppm, it is possible to reduce 0.06 mass % Nd, the existence ratio of the main phase is increased correspondingly, and it is possible to enhance the residual flux density $B_r$.

For example, since a difference of an oxygen-containing amount of A and an oxygen-containing amount of D is 680 ppm (1200 ppm-520 ppm), it is possible to reduce 0.41 mass % Nd in A with respect to D. In actuality, the Nd-containing amount of A is reduced by 0.59 mass % (0.64 mass % in terms of TRE) as compared with D. As compared with ID, A has a substantially equal coercive force $H_{cJ}$ (1.160MA/m→1.150 MA/m), and residual flux density $B_r$ is enhanced (1.463 T→1.477 T) and a maximum energy product $(BH)_{max}$ is also enhanced (408.0 kJ/m$^3$→420.1 kJ/m$^3$).

Here, A and D have substantially equal amounts of R consumed for forming the main phase and the R-rich phase. However, A has a small amount of oxide and the excessive Nd is also reduced. Therefore, the existence ratio of the main phase is relatively increased. Hence, residual flux density $B_r$ and the maximum energy product $(BH)_{max}$ are enhanced.

Like the case of A, an Nd-containing amount of B is reduced by 0.83 mass % (0.94 mass % in terms of TRE) as compared with E, an Nd-containing amount of C is reduced by 1.37 mass % (1.38 mass % in terms of TRE) as compared with F, and residual flux density $B_r$ and a maximum energy product $(BH)_{max}$ of B are enhanced as compared with E, and residual flux density $B_r$ and a maximum energy product $(BH)_{max}$ of C are enhanced as compared with F.

According to the present invention, it is possible to prevent oxidization of raw-material alloy and its power in each of the producing steps from the raw-material alloy to the sintered magnet. Hence, the R-containing amount can be reduced as compared with the conventional technique, the existence ratio of the main phase can be enhanced and as a result, it is possible to enhance residual flux density $B_r$ and a maximum energy product $(BH)_{max}$.

INDUSTRIAL APPLICABILITY

The present invention can be utilized for a producing method of a high performance R-T-B-based sintered magnet.

The invention claimed is:

1. A producing method of an R-T-B-based sintered magnet, comprising:

a coarsely pulverizing step of obtaining coarsely pulverized powder of raw-material alloy for R-T-B-based sintered magnets;

a mixing step of adding a pulverization aid to the coarsely pulverized powder and mixing the coarsely pulverized powder and the pulverization aid, wherein the pulverization aid is a hydrocarbon-based lubricant dissolved in oil in a range of 0.01 to 0.20 wt % with respect to the coarsely pulverized powder or the pulverization aid is a fatty acid or derivative of fatty acid in a range of 0.01 to 0.10 wt % with respect to the coarsely pulverized powder;

a fine pulverizing step of supplying, to a jet mill device, the coarsely pulverized powder in which the pulverization aid is mixed in the mixing step, of finely pulverizing the coarsely pulverized powder in inert gas, of recovering the fine pulverized fine pulverized powder in a solvent composed of one kind of mineral oil, synthetic oil and vegetable oil, and of obtaining slurry fine pulverized powder;

a forming step of wet forming the fine pulverized powder in a magnetic field to obtain a compact for R-T-B-based sintered magnets; and a sintering step of removing the solvent in the compact for the R-T-B-based sintered magnets, and sintering the same to obtain an R-T-B-based sintered magnet, wherein the coarsely pulverizing step includes:

a hydrogen storing step of storing hydrogen into the raw-material alloy for the R-T-B-based sintered magnet accommodated in a processing container;

a heating step of heating the coarsely pulverized powder which is pulverized by storing the hydrogen and dehydrogenating the coarsely pulverized powder;

a cooling step of cooling the heated coarsely pulverized powder; and a recovery step of recovering the cooled coarsely pulverized powder into a recovery container, the recovery step is carried out in a recovery chamber which is adjacently connected to a processing chamber where at least the cooling step is carried out, the recovery container includes inert gas introducing device 42 which introduces inert gas, evacuating device 43 which discharges gas in the recovery chamber, a carry-in port through which the processing container is carried into the recovery chamber from the processing chamber, a discharge port disposed in a lower portion of the recovery chamber, and the recovery container connected to the discharge port, the recovery step includes a carrying-in step of carrying the processing container from the processing chamber into the recovery chamber through the carry-in port after inert gas was introduced into the recovery chamber by the inert gas introducing device 42, a discharging step of discharging the coarsely pulverized powder in the processing container into the recovery chamber after a pressure in the recovery chamber was reduced by the evacuating device 43, a gas introducing step of introducing inert gas into the recovery chamber by the inert gas introducing device 42 after the coarsely pulverized powder was discharged into the recovery chamber, and an alloy accommodating step of recovering the coarsely pulverized powder into the recovery container through the discharge port after a pressure in the recovery chamber is brought into a pressure by inert gas, and addition of the pulverization aid in the mixing step is carried out in the alloy accommodating step in the recovery step after the cooling step.

2. The producing method of the R-T-B-based sintered magnet according to claim 1, wherein the coarsely pulverized powder and the pulverization aid are mixed in the mixing step by rotating the recovery container.

3. The producing method of the R-T-B-based sintered magnet according to claim 2, wherein the coarsely pulverized powder is supplied to the jet mill device by connecting the recovery container rotated in the mixing step to a raw material tank of the jet mill device.

4. The producing method of the R-T-B-based sintered magnet according to claim 3, wherein inert gas is introduced into a connecting portion between an on/off valve of the recovery container and an on/off valve of the raw material tank and oxygen concentration in the connecting portion is set to 20 ppm or less and then, the on/off valve of the recovery container and the on/off valve of the raw material tank are opened, and the coarsely pulverized powder in the recovery container is supplied to the raw material tank.

5. The producing method of the R-T-B-based sintered magnet according to claim 1, wherein the jet mill device finely pulverizes the coarsely pulverized powder in inert gas in which oxygen concentration is 20 ppm or less.

6. The producing method of the R-T-B-based sintered magnet according to claim 1, wherein an oxygen-containing amount of the R-T-B-based sintered magnet obtained in the sintering step is set to 600 ppm or less.

7. The producing method of the R-T-B-based sintered magnet according to claim 1, wherein one kind of mineral oil, synthetic oil and vegetable oil is sprayed to or dropped onto the compact for the R-T-B-based sintered magnet obtained in the forming step.

8. The producing method of the R-T-B-based sintered magnet according to claim 1, wherein the recovery chamber includes turn-over device 44 for turning over the processing container upside down, the processing container is provided at its upper surface with an opening, and the raw-material alloy for the R-T-B-based sintered magnet in the processing container is discharged by an upside down turning over operation carried out by the turn-over device 44.

9. The producing method of the R-T-B-based sintered magnet according to claim 8, wherein after the upside down turning over operation was carried out by the turn-over device 44, the turn-over device 44 carries out a swinging operation in a state where the opening is directed downward.

10. The producing method of the R-T-B-based sintered magnet according to claim 8, wherein the processing container is provided with a lid which covers the opening thereof, the opening is covered with the lid when the evacuating device 43 carries out a decompressing operation, and the lid is detached from the opening after the pressure in the recovery chamber was reduced by the evacuating device 43 and before the upside down turning over operation is carried out by the turn-over device 44.

11. The producing method of the R-T-B-based sintered magnet according to claim 10, wherein the hydrogen storing step, the heating step and the cooling step are carried out in a state where the opening of the processing container is covered with the lid.

12. The producing method of the R-T-B-based sintered magnet according to claim 1, wherein the raw-material alloy for the R-T-B-based sintered magnet is discharged from the processing container under a reduced pressure of 1000 Pa to 1 Pa in the recovery chamber.

13. The producing method of the R-T-B-based sintered magnet according to claim 1, wherein inert gas is previously substituted for air in the recovery container such that oxygen concentration becomes 20 ppm or less, and the pressure in the recovery chamber is set to the same as the pressure in the recovery container.

* * * * *